US009260921B2

(12) United States Patent
Graham et al.

(10) Patent No.: US 9,260,921 B2
(45) Date of Patent: Feb. 16, 2016

(54) SYSTEM AND METHODS FOR CONSTRUCTING AND FRACTURE STIMULATING MULTIPLE ULTRA-SHORT RADIUS LATERALS FROM A PARENT WELL

(75) Inventors: Stephen A. Graham, Houston, TX (US); Philip W. Woodard, Katy, TX (US); Robert F. Shelley, Katy, TX (US); Jim B. Surjaatmadja, Duncan, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 1783 days.

(21) Appl. No.: 12/123,957

(22) Filed: May 20, 2008

(65) Prior Publication Data

US 2009/0288833 A1 Nov. 26, 2009

(51) Int. Cl.

| | |
|---|---|
| ***E21B 7/04*** | (2006.01) |
| ***E21B 43/26*** | (2006.01) |
| ***E21B 7/18*** | (2006.01) |
| ***E21B 43/114*** | (2006.01) |

(52) U.S. Cl.

CPC . *E21B 7/18* (2013.01); *E21B 7/046* (2013.01); *E21B 43/114* (2013.01); *E21B 43/26* (2013.01)

(58) Field of Classification Search

USPC ..... 166/117.5, 255.3; 175/67, 77, 78, 79, 175/80, 81, 82, 424

See application file for complete search history.

(56) References Cited

U.S. PATENT DOCUMENTS

| | | | |
|---|---|---|---|
| 2,007,465 | A | 7/1935 | Burt |
| 3,595,314 | A | 7/1971 | Garner |
| 4,102,401 | A | 7/1978 | Erbstoesser |
| 4,139,060 | A | 2/1979 | Muecke et al. |
| 4,160,482 | A | 7/1979 | Erbstoesser et al. |
| 4,195,690 | A | 4/1980 | Erbstoesser et al. |
| 4,244,425 | A | 1/1981 | Erbstoesser |
| 4,287,952 | A | 9/1981 | Erbstoesser |
| 4,505,334 | A | 3/1985 | Doner et al. |
| 4,790,384 | A | 12/1988 | Schellstede et al. |

(Continued)

FOREIGN PATENT DOCUMENTS

| | | | |
|---|---|---|---|
| WO | 9809053 | A2 | 3/1998 |

OTHER PUBLICATIONS

International Preliminary Report on Patentability issued Dec. 2, 2010, for International Patent Application No. PCT/US09/043074, 6 pages.

(Continued)

*Primary Examiner* — Robert E Fuller

(74) *Attorney, Agent, or Firm* — Scott Brown; Tumey L.L.P.

(57) ABSTRACT

Systems and methods for multi-lateral wellbore construction and stimulation from cased parent wellbores. Methods and apparatus are provided to facilitate the creation of casing exit openings in the casing of parent wellbores. Methods and systems are provided for azimuthally and longitudinally aligning drilling assemblies through openings in a parent wellbore casing are provided to allow for drilling multiple lateral wellbores extending outwardly from a parent wellbore. A method of stimulating one or more subterranean zones intersected by multiple lateral wellbores extending outwardly from one or more parent wellbores includes the steps of: simultaneously injecting a stimulation fluid into the lateral wellbores; and stimulating the zones intersected by the lateral wellbores in response to the stimulation fluid injecting step.

8 Claims, 23 Drawing Sheets

(56) References Cited

U.S. PATENT DOCUMENTS

| | | | | |
|---|---|---|---|---|
| 4,928,757 | A | 5/1990 | Schellstede | |
| 5,107,943 | A | 4/1992 | McQueen et al. | |
| 5,309,995 | A | 5/1994 | Gonzalez et al. | |
| 5,327,970 | A | 7/1994 | McQueen et al. | |
| 5,392,858 | A | 2/1995 | Peters et al. | |
| 5,462,120 | A | 10/1995 | Gondouin | |
| 5,485,882 | A | 1/1996 | Bailey et al. | |
| 5,615,740 | A | 4/1997 | Comeau et al. | |
| 5,765,642 | A | 6/1998 | Surjaatmadja | |
| 5,875,847 | A | 3/1999 | Forsyth | |
| 5,884,698 | A * | 3/1999 | Hughes et al. | 166/117.6 |
| 6,041,855 | A | 3/2000 | Nistor | |
| 6,073,697 | A | 6/2000 | Parlin et al. | |
| 6,095,248 | A | 8/2000 | Freeman | |
| 6,145,593 | A | 11/2000 | Hennig | |
| 6,167,968 | B1 | 1/2001 | Allarie et al. | |
| 6,263,984 | B1 | 7/2001 | Buckman, Sr. et al. | |
| 6,267,181 | B1 | 7/2001 | Rhein-Knudsen et al. | |
| 6,332,498 | B1 * | 12/2001 | George | 166/50 |
| 6,530,439 | B2 | 3/2003 | Mazorow | |
| 6,578,636 | B2 | 6/2003 | Mazorow et al. | |
| 6,668,636 | B2 | 12/2003 | Buckman, Sr. et al. | |
| 6,913,082 | B2 | 7/2005 | McGlothen et al. | |
| 7,104,332 | B2 | 9/2006 | Murray et al. | |
| 7,357,182 | B2 | 4/2008 | Hunt et al. | |
| 2002/0056572 | A1 | 5/2002 | Hanton et al. | |
| 2005/0087340 | A1 | 4/2005 | Zupanick et al. | |
| 2005/0230107 | A1 * | 10/2005 | McDaniel et al. | 166/249 |
| 2007/0095530 | A1 | 5/2007 | Jelsma | |
| 2007/0107902 | A1 | 5/2007 | Jelsma | |
| 2007/0181304 | A1 | 8/2007 | Rankin et al. | |
| 2007/0181308 | A1 | 8/2007 | Jelsma | |

OTHER PUBLICATIONS

International Search Report and Written Opinion issued Jun. 26, 2009, for International Patent Application Serial No. PCT/US09/43074, 7 pages.

E & P Hart Energy Publishing, Global Exploration & Production News, "Coiled Tubing Operations," 3 pages, dated Mar. 2008.

Halliburton Production Optimization, "CobraMax Fracturing Service," 2 pages, dated May 2005.

Halliburton Completion Tools, "Delta Stim™ Sleeve," 2 pages, dated Oct. 2007.

Halliburton Stimulation, "H2Zero™ Service," 2 pages, dated Mar. 2008.

Halliburton Completion Tools, "Mirage® Disappearing Plug and Autofill Sub," 2 pages, dated Aug. 2005.

Penetrators, "The PeneDRILL® Tool," product brochure, 2 pages, dated 2004.

Perf-Drill, "Perforation Tunnel Tool," 19 pages, undated.

PetroJet®, "Advanced Fluid Jet Drilling Systems Technology for Oil and Gas Production," 24 pages, dated May 2007.

Halliburton Sperry Drilling Services, "SperryRite® Advanced Reservoir Drainage Services," 2 pages, dated Sep. 2007.

Radial Drilling Services, "Radial Drilling Services Technology," 1 page, dated 2008.

Halliburton Wireline and Perforating Services, "RSCT™ (Rotary Sidewall Coring Tool)," 2 pages, dated Mar. 2008.

Rotary Sidewall Coring Tool (RSCT™), "Easily Acquire up to 30 Undistorted Core Samples in a Single Pass," 1 page undated.

W. Dickinson, et al., SPE 14804 Drilling Engineering, "The Ultrashort-Radius Radial System," pp. 247-254, dated Sep. 1989.

Jeffrey Foster, et al., SPE 39367, "Improving Multilateral Drilling and Completion Efficiency with a Hollow Whipstock," 12 pages, dated 1998.

Halliburton Sperry Drilling Services, "SperryRite® Advanced Reservoir Drainage Services," 2 pages, dated Oct. 2007.

Halliburton Stimulation, "Surgifrac Service," 2 pages, dated Aug. 2005.

Weatherford, "Ratcheting Orienter," 2 pages, dated 2004.

Well Enhancement, "Radial Jet Enhancement Technology Information," 3 pages, dated 2007.

Office Action issued Oct. 5, 2009, for U.S. Appl. No. 12/124,895, 15 pages.

* cited by examiner

SYSTEM AND METHODS FOR CONSTRUCTING AND FRACTURE STIMULATING MULTIPLE ULTRA-SHORT RADIUS LATERALS FROM A PARENT WELL

BACKGROUND

The present disclosure relates to the recovery of hydrocarbons in certain oil and gas field developments wherein the hydrocarbons are contained within one or a multitude of low permeability, tight reservoirs which require advanced drilling and completion techniques such as multi-lateral well construction with fracture stimulated completions in order to establish commercial production. In these environments, the hydrocarbons are often dispersed in a stacked sequence of tight, hydrocarbon-bearing reservoirs (i.e., sandstones, carbonates, or brittle shales having high organic carbon content) together with impermeable, non-productive formations (i.e., ductile shales or salts). Due to the relatively small size of each reservoir compartment and/or limited drainage ability of completions targeting these hydrocarbon-bearing reservoirs, comingling of many separate zones into a single completion with the downhole pump of an artificial lift system placed below the completed reservoirs is often required to achieve efficient and economic exploitation.

In some cases, these tight reservoirs have substantially vertical-oriented natural fractures which enhance the production potential of the well completions when the natural fractures are effectively communicated with the well by a wellbore penetration and/or hydraulic fracture stimulation treatment. Penetrating a vertically-oriented natural fracture with a substantially vertical wellbore is difficult. Additionally, it is difficult to effectively propagate an induced hydraulic fracture away from a substantially vertical wellbore in a direction which will allow for interception with vertically-oriented natural fractures when the azimuth direction of the natural fractures is substantially parallel with the present-day maximum principal horizontal stress direction. In these cases, the induced hydraulic fracture will typically be oriented parallel with the natural fractures and thus will not intercept or otherwise communicate the substantially vertical wellbore with the natural fractures. An obvious solution to this problem is to drill a horizontal wellbore in a direction which will allow for interception with the natural fractures, but using conventional short, medium, or long radius horizontal drilling technology to accomplish this goal is not practical because of the number of such horizontal wellbores which would be required to exploit the multiple stacked reservoir compartments.

In other cases, the tight reservoirs are not substantially naturally fractured and contain hydrocarbons primarily in micro-pores contained in the tight reservoir rock matrix. In many of these situations, commercial production can only be established through effective fracture stimulation of horizontal lateral wellbores. These fracture stimulated lateral completions are designed to maximize exposure of the tight reservoir with the wells and the stimulated reservoir volume connected to the well completion. However, in many cases the hydrocarbons located within a single reservoir compartment are not present in sufficient quantities to justify drilling and completing a conventional short, medium, or long radius horizontal wellbore with fracture stimulation treatment targeting a single reservoir compartment due to the cost associated with such conventional exploitation methodology. Additionally, in some cases the strata located in close proximity above or below the targeted reservoir compartment contain excessive quantities of formation water. In many of these cases, there are not sufficient barriers to contain fracture height growth within the targeted reservoir compartment if conventional massive hydraulic fracture stimulation techniques are utilized.

To address these challenges, new drilling and completion approaches are required that allow for low cost construction of multi-lateral wells with fracture stimulation treatments that allow for effectively communicating the wells with natural fracture systems contained within multiple stacked reservoirs. New multi-lateral well construction approaches are also needed for maximizing stimulated reservoir volume while avoiding the creation of induced hydraulic fractures which extend into the adjacent water-bearing formations or which otherwise fracture out-of-zone.

The present disclosure relates generally to equipment utilized and operations performed in conjunction with the construction of subterranean wells having a multitude of ultra-short radius lateral wellbores extending from cased main or parent wellbores to intercept natural fractures and/or to maximize exposure of the wells with a multitude of subterranean formations containing hydrocarbons or other valuable materials. In an embodiment described herein, the disclosure more particularly provides systems and methods for stimulating and producing parent wells having multiple lateral wellbores in order to complete multiple reservoir compartments for a comingled production with a downhole pump located below all completed reservoirs and to maximize the stimulated reservoir volume of each completed reservoir. The methods of this disclosure will provide for interception of vertically oriented natural fractures and/or effectively creating complex induced fractures in the targeted reservoirs while avoiding growing fractures into adjacent water-bearing formations or other non-productive strata. The system and methods of the present disclosure also provide for selective isolation of specific completed zones or reservoirs which are found to produce excessive quantities of formation water after completion with a lateral wellbore and/or a fracture stimulation treatment.

Improvements are continually needed in the arts of drilling and stimulating multi-lateral wells. For example, one technique for drilling lateral wellbores involves the use of a drilling assembly which is capable of drilling "ultra-short" radius lateral wellbores. The present specification is not limited to this particular ultra-short radius wellbore drilling art, but it is useful to demonstrate examples of the kinds of improvements needed.

In the ultra-short radius wellbore construction art, a lateral wellbore is typically drilled or jetted from a parent wellbore with a turn radius from vertical to horizontal (i.e., 90 degrees) in less than 5 feet. The parent wellbore is in many cases lined with a casing string made of a very strong and durable material, such as steel. Usually external to the casing string is a cement material which is hard and brittle, with relatively high compressive strength to provide for isolation between hydrocarbon-bearing zones as well as other formations in the annulus between the casing string and the wellbore.

It is generally necessary to mill, drill or otherwise cut through the casing string and the cement with one type of assembly, retrieve the assembly, and then use another type of assembly for drilling the lateral wellbore. This procedure is time-consuming (and, therefore, expensive) and requires that multiple assemblies be accurately aligned with respect to the casing string and targeted hydrocarbon-bearing zones in order for the successful construction of the lateral wellbore. These problems are compounded when multiple lateral wellbores are to be drilled from the same parent wellbore into one or a multitude of hydrocarbon-bearing zones. Additionally, when ultra-short radius drilling techniques are employed, limitations exist in the current art for cutting through casing strings comprised of relatively hard steel (i.e., greater than grade N-80 pipe) or thick walled pipe (i.e., greater than 1 cm).

Furthermore, adequate systems and methods have not been developed for stimulating the one or more zones completed from a parent well with a multitude of ultra-short radius laterals. For example, one of the problems encountered in the ultra-short radius wellbore construction art is that the lateral wellbores drilled or jetted using the technique are generally relatively small in diameter, and so typical stimulation equipment and procedures cannot be used effectively. In addition, the relatively large number of lateral wellbores to be stimulated means that it is very time-consuming (and, therefore, expensive) to individually stimulate the zones or reservoirs intersected by each wellbore.

The disadvantages of the prior art are overcome by the present disclosure, and an improved system and method are hereinafter disclosed for constructing and fracture stimulating multi-laterals from a parent well.

SUMMARY

In the present specification, systems and methods are provided for drilling multiple ultra-short radius lateral wellbores extending outwardly from a cased parent wellbore which alleviate the need for cutting through a sidewall of the casing using a milling assembly which has limitations related to the hardness or wall thickness of the steel casing. Additionally, the present disclosure provides systems and methods for effectively treating the multitude of lateral wellbores and the hydrocarbon-bearing reservoirs they penetrate using simultaneous and/or sequential fracture stimulation treatments via one or more parent wellbores using novel diversion means.

In one embodiment, the system includes one or a multitude of casing sections cemented in the parent wellbore adjacent to a hydrocarbon-bearing zone targeted for one or more lateral wellbores using acid soluble cement. Each casing section contains one or a multitude of azimuthally and/or longitudinally-spaced machined hole openings together with an orienting device which is positioned within the casing section such that the exact longitudinal distance and azimuthal orientation between the orienting device and each hole is known.

Once the casing string containing the one or a multitude of casing sections is run and cemented in the parent wellbore, a diverter assembly comprising an orienting tool at its lower end, an azimuthal and/or longitudinal indexing device, and a diverter device at its upper end is run inside the casing string on a work string whereby when the orienting tool is temporarily attached to the orienting device in the lowermost casing section, the diverter device is precisely positioned adjacent to the lowermost hole of the lowermost casing section to facilitate the exit of a drilling assembly run inside the work string for drilling a lateral through the lowermost hole.

After drilling a first lateral through the lowermost hole of the lowermost casing section, the indexing tool is cycled to position the diverter device precisely adjacent to the next higher hole in the lowermost casing section to allow for the drilling of the next lateral wellbore. In a similar manner, all laterals to be drilled or jetted from the parent well through the succession of pre-machined holes in the lowermost casing section are constructed.

After constructing all of the laterals from the lowermost casing section, the diverter assembly is detached from the orienting device of the lowermost casing section and moved to the next higher casing section where the lateral construction process is repeated in a similar fashion.

Upon completion of the lateral wellbore construction process, the geometry of the machined hole openings in the casing sections will allow for sequential fracture stimulation treatments using degradable, spherically-shaped ball sealers which are sized slightly larger than the diameter of the hole openings in the casing sections. In this sequential fracture stimulation process, the ball sealers are released to the stimulation fluids from a location above the targeted lateral wellbores (i.e., from the surface) in stages to intentionally divert stimulation fluids which are being predominately injected into a particular lateral into one or more additional laterals. For example, if eight laterals extending from a parent well are to be stimulated using this process, approximately seven ball sealers would be used to divide each of eight fracture stimulation stages. This sequential fracture stimulation process is intended to ensure each lateral is effectively stimulated and to promote the alteration of the effective in-situ stress state in the targeted zones in near real-time, thus promoting the creation of highly productive complex induced fracture systems.

In addition, multiple closely spaced parent wells each having a multitude of lateral wellbore completions in a certain targeted reservoir may be simultaneously fracture stimulated which will further alter the effective in-situ stress state in the targeted zones in near real-time, thus promoting the creation of even more productive complex induced fracture systems.

It is also contemplated that specific zones and/or clusters of multi-lateral wellbores may be initially fracture stimulated, produced for a period of time, and then re-fracture stimulated in order to further promote the creation of very complex fracture systems by taking advantage of the changed effective in-situ stress state in the targeted reservoirs. With this method, not all induced fractures will be created parallel to the present-day in-situ maximum horizontal stress direction, thus allowing the well completion to have more exposure to the reservoir. Additionally, application of this method will reduce the chance of fracturing out-of-zone in situations where there is not a significant difference in stress and/or rock strength properties between the targeted reservoir and the adjacent formations because the injection rates into each well will be significantly less than the rate which would be required to create the same degree of induced fracture networks if a single well with a single lateral was treated using conventional completion practices.

A further aspect of the specification includes the method of varying the profile (i.e., hole size and/or shape) along the length of each lateral to optimize the distribution of hydraulic fracture energy along the length of each lateral during a fracture stimulation treatment. The lateral hole size and shape along the length of each lateral may be purposely adjusted by varying the jetting time and/or jet nozzle configuration at different points along the length of the lateral either during the initial lateral construction process or subsequent to jetting the original lateral wellbore. Using this method, friction pressure losses may be purposely managed along the length of each lateral and/or fracture initiation points may be intentionally created at specific locations within each lateral. Optimizing the distribution of hydraulic fracture energy and creating certain fracture initiation or breakdown points along the length of each lateral will improve the efficiency and effectiveness of the fracture stimulation treatments which target each lateral wellbore and maximize the stimulated reservoir volume of each targeted reservoir, thus promoting maximum recovery of hydrocarbons contained in the reservoirs.

In another embodiment, the system includes one or a multitude of casing sections cemented in the parent wellbore adjacent to a hydrocarbon-bearing zone targeted for one or more lateral wellbores using acid soluble cement. Each casing section contains one or a multitude of sliding sleeve or valve devices each having one or a multitude of azimuthally and/or longitudinally-spaced machined hole openings together with an orienting device which is positioned within the casing section such that the exact longitudinal distance and azimuthal orientation between the orienting device and each hole contained within the valve device is known. This information will allow for the configuration of a diverter assembly similar to the one described above to be used in order to facilitate the construction of one or more lateral wellbores through the hole openings in the valve devices using the previously described process. The valve devices will allow selective isolation of specific zones by opening and closing various valve devices during the lateral construction or completion process.

In yet another embodiment, the system includes one or a multitude of casing sections cemented in the parent wellbore adjacent to a hydrocarbon-bearing zone targeted for one or more lateral wellbores using acid soluble cement. Each casing section contains an orienting device which is positioned within the casing section to facilitate cutting hole openings in the sidewall of the casing and cement sheath after the casing string is cemented in the parent wellbore using a rotary sidewall coring or milling tool assembly. The rotary sidewall coring or milling tool assembly comprises an orienting tool at its lower end, an azimuthal and/or longitudinal indexing device, and an electric-line powered sidewall coring or milling tool at its upper end and is run inside the casing string on a work string. Once the orienting tool is temporarily attached to the orienting device in the lowermost casing section, the rotary sidewall coring or milling tool is precisely positioned adjacent to the lowermost targeted reservoir and then the rotary sidewall coring or milling tool is engaged to cut or mill a first hole such that the exact longitudinal distance and azimuthal orientation between the orienting device and the first hole in the casing section is known.

After drilling the first lateral through the lowermost hole of the lowermost casing section, the indexing tool is cycled to position the rotary sidewall coring or milling tool precisely adjacent to the next targeted casing exit location above the first hole in the lowermost casing section to allow for the drilling of the next lateral wellbore. In a similar manner, additional casing exit hole openings may be created in the lowermost casing section. The geometric dimensions of the rotary sidewall coring or milling assembly together with the known location of the orienting device in the lowermost casing section will ensure the exact longitudinal distance and azimuthal orientation between the orienting device and each hole contained within the lowermost casing section is known. This information will allow for the configuration of a diverter assembly similar to the one described above to facilitate the construction of one or multiple lateral wellbores through the hole openings cut in the casing sections using the previously described process.

In yet another embodiment, the system includes one or a multitude of casing sections cemented in the parent wellbore adjacent to a hydrocarbon-bearing zone targeted for one or more lateral wellbores using acid soluble cement. Each casing section contains an orienting device which is positioned within the casing section to facilitate cutting hole openings in the sidewall of the casing and cement sheath after the casing string is cemented in the parent wellbore using a jet cutting assembly. The jet cutting assembly comprises an orienting tool at its lower end and a jet cutting device having a multitude of jet nozzles at its upper end and is run inside the casing string on a work string. Once the orienting tool is temporarily attached to the orienting device in the lowermost casing section, the jet cutting device is precisely positioned adjacent to the lowermost targeted reservoir and then sand-laden fluid is pumped down a work string and through the series of nozzles in a jet cutting device to cut a multitude of hole openings such that the exact longitudinal distance and azimuthal orientation between the orienting device and each hole jetted in the casing section is known. This information will allow for the configuration of a diverter assembly similar to the one described above to facilitate the construction of one or multiple lateral wellbores through the hole openings cut in the casing sections using the previously described process.

In yet another embodiment, the system includes setting a retrievable or drillable mule shoe latch assembly in the parent well casing at a location just below a specific targeted reservoir for radial wellbore construction. The mule shoe latch assembly consists of a bridge plug at its lower end and a mule shoe profile device at its upper end. Once the mule shoe latch assembly is set in the parent well casing, the previously described jet cutting assembly is used to cut casing exit hole openings to allow for the multiple lateral construction according to the previously described process.

In yet another aspect, a method of drilling multiple lateral wellbores extending outwardly from a parent wellbore includes, for each of the lateral wellbores, performing the following steps during a single trip of a drill string into the parent wellbore: a) drilling the lateral wellbore by displacing the drill string into a formation surrounding the parent wellbore; and b) stimulating the formation by flowing a stimulation fluid through the drill string and outward into the formation.

In a further aspect, a method of drilling one or more lateral wellbores extending outwardly from a parent wellbore includes the steps of: engaging a cutting assembly with an orienting device corresponding to a casing section in the parent wellbore, such engagement achieving a predetermined azimuthal and longitudinal position of the cutting assembly relative to a first desired location for drilling a first one of the lateral wellbores; cutting a first opening through the casing section using the cutting assembly; and then engaging a drilling assembly with the orienting device, thereby azimuthally and longitudinally aligning the drilling assembly with the first opening.

These and other features, advantages, benefits and objects will become apparent to one of ordinary skill in the art upon careful consideration of the detailed description of representative embodiments hereinbelow and the accompanying drawings, in which similar elements are indicated in the various figures using the same reference numbers.

DETAILED DESCRIPTION

It is to be understood that the various embodiments described herein may be utilized in various orientations, such as inclined, inverted, horizontal, vertical, etc., and in various configurations, without departing from the principles of the present disclosure. The embodiments are described merely as examples of useful applications of the principles of the disclosure, which are not limited to any specific details of these embodiments.

In the following description of the representative embodiments of the disclosure, directional terms, such as "above", "below", "upper", "lower", etc., are used for convenience in referring to the accompanying drawings. In general, "above", "upper", "upward" and similar terms refer to a direction toward the earth's surface along a wellbore, and "below", "lower", "downward" and similar terms refer to a direction away from the earth's surface along the wellbore.

Figure 1:
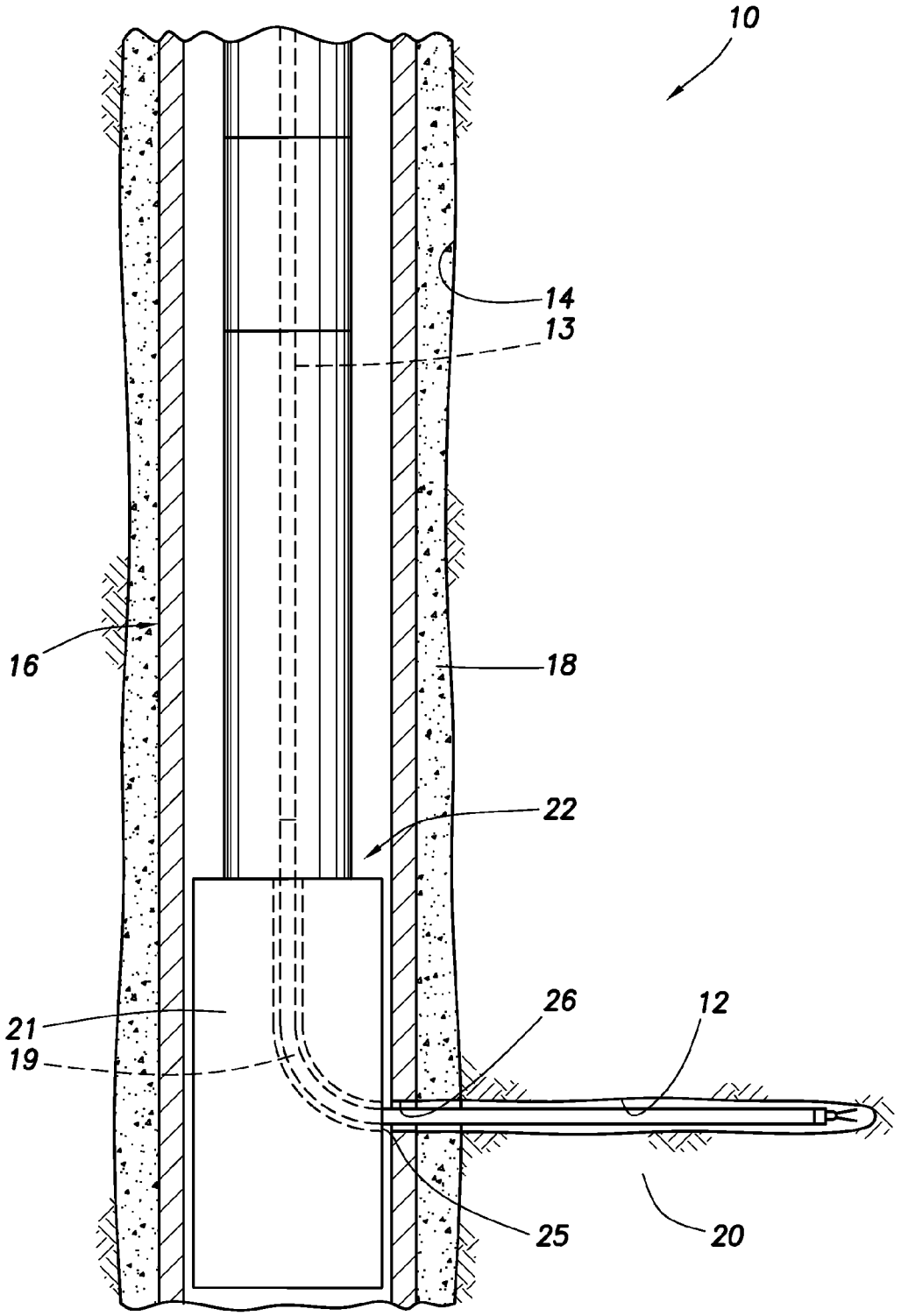
FIG. 1 (PRIOR ART)
FIG. 1 is a schematic partially cross-sectional view of a prior art system and method for drilling a lateral wellbore.

Representatively illustrated in FIG. 1 is a prior art system 10 and associated method for drilling a lateral wellbore 12. The lateral wellbore 12 is being drilled or jetted outwardly from a main or parent wellbore 14 which extends generally vertically from the earth's surface. The parent wellbore 14 is lined with a casing string 16 which is secured and sealed in the parent wellbore with cement 18.

Note that the casing string 16 and cement 18 must be cut through prior to drilling the lateral wellbore 12 into a formation 20 surrounding the parent wellbore 14. Although not shown in FIG. 1, generally a separate milling or drilling assembly is used to cut through the casing string 16 and cement 18 prior to drilling the lateral wellbore 12.

As depicted in FIG. 1, a diverter device 21 is run inside of casing string 16 on work string 22 such that a lower end face 25 of the diverter device 21 is positioned adjacent to the first zone or location targeted for a lateral wellbore 12. It will be appreciated that accurately positioning the diverter device 21 so that the drilling assembly 19 is precisely aligned with an opening 26 previously cut through the casing string 16 and cement 18 is a difficult matter. Additionally, other prior art methods allow for milling opening 26 through the casing string 16 and cement 18 using diverter device 21 and a small mill and mud motor (not shown) conveyed with small diameter coil tubing 13 alleviates the need for the above referenced precise alignment, but such prior art method has significant limitations with respect to the thickness and hardness of the steel casing wall 16 which can be cut. It will also be appreciated that effectively stimulating the formation 20 or a zone surrounding the lateral wellbore 12 is difficult due in part to the relatively small diameter of the lateral wellbore.

Figure 2:
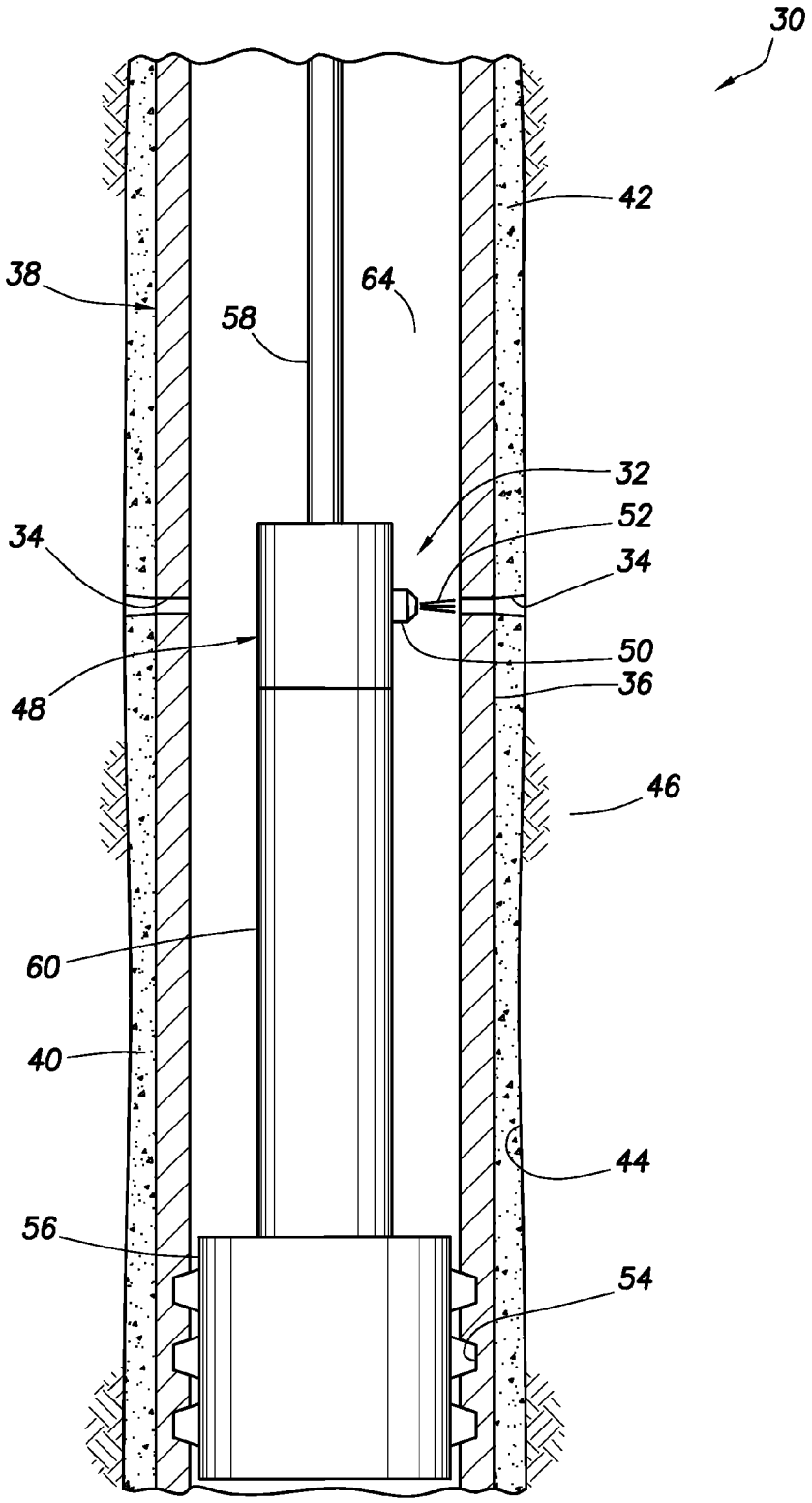
FIG. 2 is a schematic partially cross-sectional view of a system and method for forming openings through a sidewall of a casing section in an overall system and method for drilling and stimulating multiple lateral wellbores embodying principles of the present specification.

Referring additionally now to FIG. 2, a system 30 and associated method for drilling multiple lateral wellbores extending outwardly from a parent wellbore are representatively illustrated. In the system 30, a jet cutting assembly 32 is used to form openings 34 through a sidewall of a section 36 of a string of casing 38, and through cement 40 external to the casing section 36. The cement 40 is located in an annulus 42 between the casing 38 and a parent wellbore 44 drilled into a subterranean formation 46.

As used herein, the terms "casing," "casing string," and similar terms are used to indicate a protective lining for a wellbore, and encompass elements known to those skilled in the art as casing, liner, tubing, etc. Casing can be segmented or continuous, conveyed into the wellbore from the surface or formed in situ, expanded or otherwise deformed downhole, etc.

As used herein, the term "cement" and similar terms are used to indicate a hardenable material which is used to seal and secure casing in a wellbore. Cement may be cementitious, but could alternatively or additionally be made of a hardenable resin, various polymers or gels, etc.

In the illustrated method, it is desired to drill multiple lateral wellbores (not shown in FIG. 2) extending outwardly from the parent wellbore 44. The openings 34 are formed at predetermined locations where the lateral wellbores are to be drilled.

The jet cutting assembly 32 includes a jet cutting device 48 with a jet nozzle 50 for ejecting a cutting fluid 52 therefrom to erode the openings 34 through the casing section 36 and cement 40. Although only one nozzle 50 is depicted in FIG. 2, any number of nozzles may be provided in the jet cutting device 48 for cutting any number of openings 34.

For accurately positioning the jet cutting assembly 32 both azimuthally and longitudinally relative to the casing section 36, the assembly is engaged with an orienting device 54 interconnected in the casing string 38. When the assembly 32 is conveyed into the casing string 38, an orienting tool 56 of the assembly cooperatively engages the orienting device 54, which thereby causes the jet cutting device 48 to be azimuthally and longitudinally aligned with the desired locations for cutting the openings 34.

The orienting device 54 may comprise an internal orienting profile, for example, of the type used in the Sperry Orienting Latch Coupling available from Sperry Drilling Services of Houston, Tex. USA. In that case, the orienting tool 56 may comprise an orienting latch, for example, of the type used in the Sperry Orienting Latch also available from Sperry Drilling Services. However, it should be understood that other types of orienting devices and tools may be used in keeping with the principles of the present disclosure.

As depicted in FIG. 2, the orienting device 54 is interconnected as a part of the casing string 38, for example, at the time the parent wellbore 44 is originally cased. However, it will be appreciated that the orienting device 54 could be secured in the casing string 38 at a subsequent time, for example, by connecting the orienting device to an anchoring device (such as a bridge plug or packer, etc.) and setting the anchoring device in the casing string so that the orienting device is appropriately longitudinally and azimuthally oriented relative to the desired locations of the openings 34.

A suitable jet cutting device which may be used for the jet cutting device 48 in the system 30 is the HYDRA-JET™ available from Halliburton Energy Services of Houston, Tex. USA. The fluid 52 which is ejected from the nozzle 50 may be combined with an abrasive, such as sand, to more efficiently erode the openings 34 through the sidewall of the casing section 36 and the cement 40. A tubing or work string 58 may be used to deliver the pressurized fluid 52 to the jet cutting device 48 from a remote location, such as the earth's surface.

To further facilitate efficient cutting of the openings 34 through the cement 40, the cement can be at least partially acid-soluble and the fluid 52 can include an acidic component (such as hydrochloric or hydrofluoric acid). In this manner, the openings 34 can be relatively quickly formed through the cement 40. However, it is not necessary for the cement 40 to be acid-soluble in keeping with the principles of the present disclosure.

If the number of openings 34 to be formed is greater than the number of nozzles 50 in the jet cutting device 48, then an indexing device 60 may be used to incrementally index the nozzle(s) 50 into azimuthal and longitudinal alignment with the desired location(s) for forming each of the additional opening(s) 34. The indexing device 60 is preferably positioned between the orienting tool 56 and the jet cutting device 48, so that the jet cutting device can be accurately oriented relative to the casing section 36.

The indexing device 60 is preferably of the type which is mechanically or hydraulically operated to provide successive azimuthal and/or longitudinal orientations between its opposite ends. For example, pressure applied to the indexing device 60 may cause the azimuthal orientation and longitudinal displacement between its opposite ends to change, or the indexing device could include a mechanical J-slot or other ratcheting device which operates in response to manipulations of the tubing string 58, etc. Any type of azimuthal and longitudinal indexing device may be used for the device 60 in keeping with the principles of this disclosure.

Thus, in the case where only a single nozzle 50 is used and four of the openings 34 are to be formed, the method may include the steps of engaging the orienting tool 56 with the orienting device 54 to thereby align the nozzle with a desired location for a first one of the openings, forming the first opening by ejecting the cutting fluid 52 from the nozzle 50, operating the indexing device 60 to azimuthally and/or longitudinally align the nozzle with a desired location for a second opening, forming the second opening, operating the indexing device to again azimuthally and/or longitudinally align the nozzle with a desired location for a third opening, forming the third opening, operating the indexing device to again azimuthally and/or longitudinally align the nozzle with a desired location for a fourth opening, and forming the fourth opening. However, as mentioned above, any number of the nozzle(s) 50 and opening(s) 34 may be used in the system 30.

Figure 5:
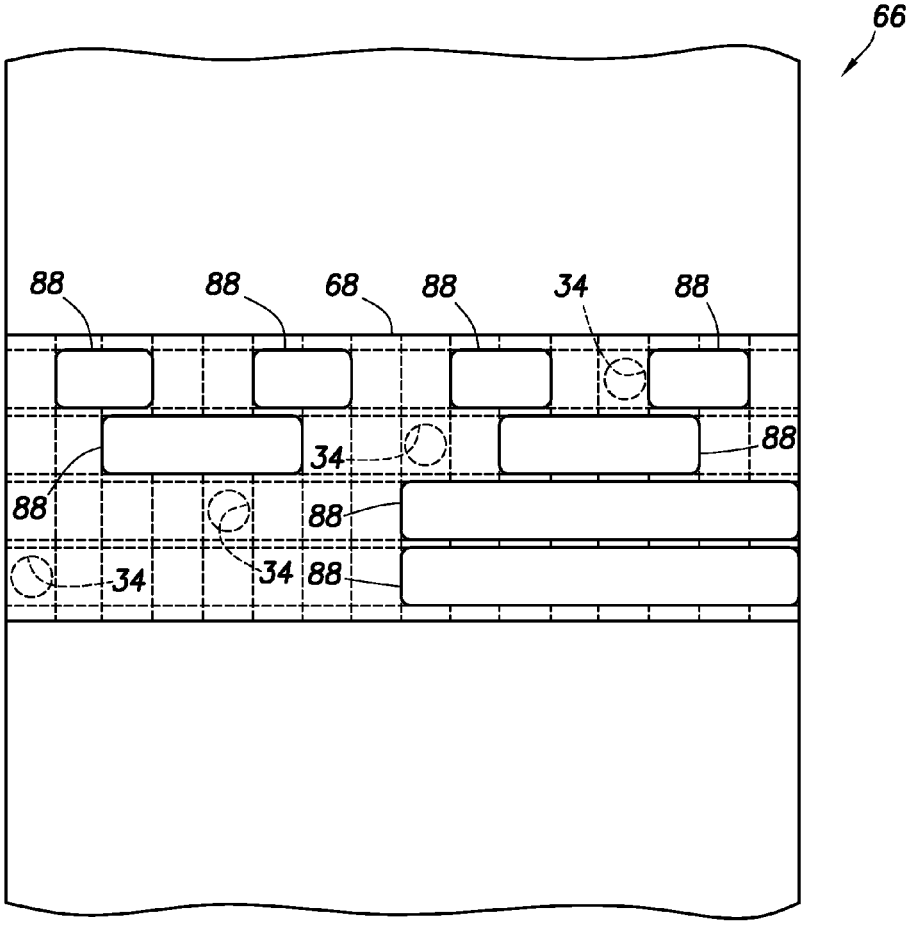
FIG. 5 is an enlarged scale schematic view of a valve and closure device which may be used in conjunction with the system and method of FIG. 4.
Figure 11:
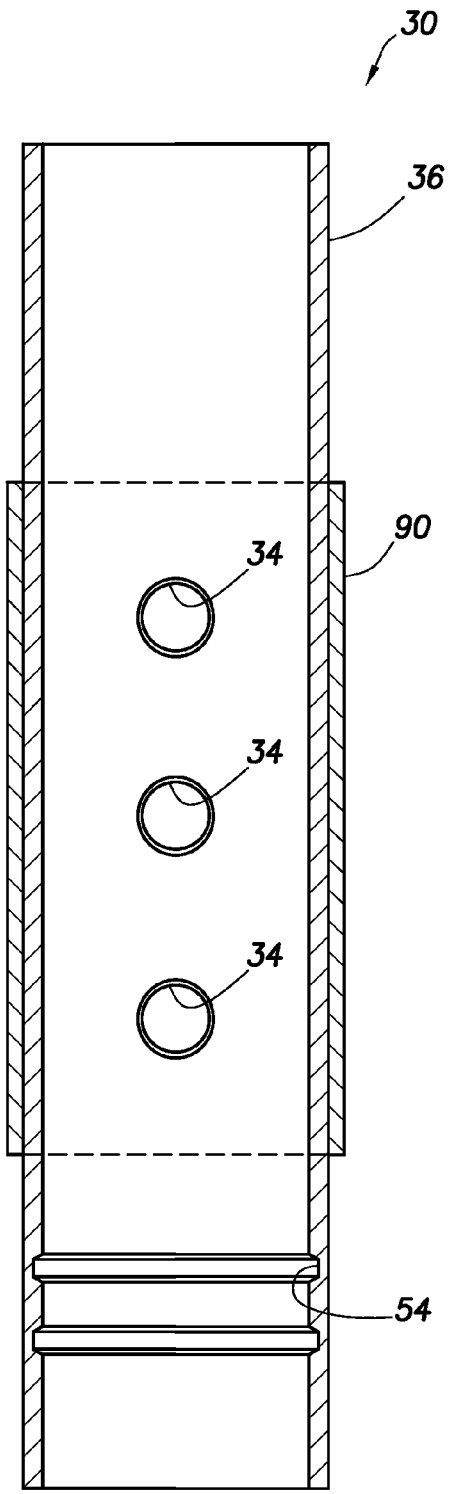
Figure 12:
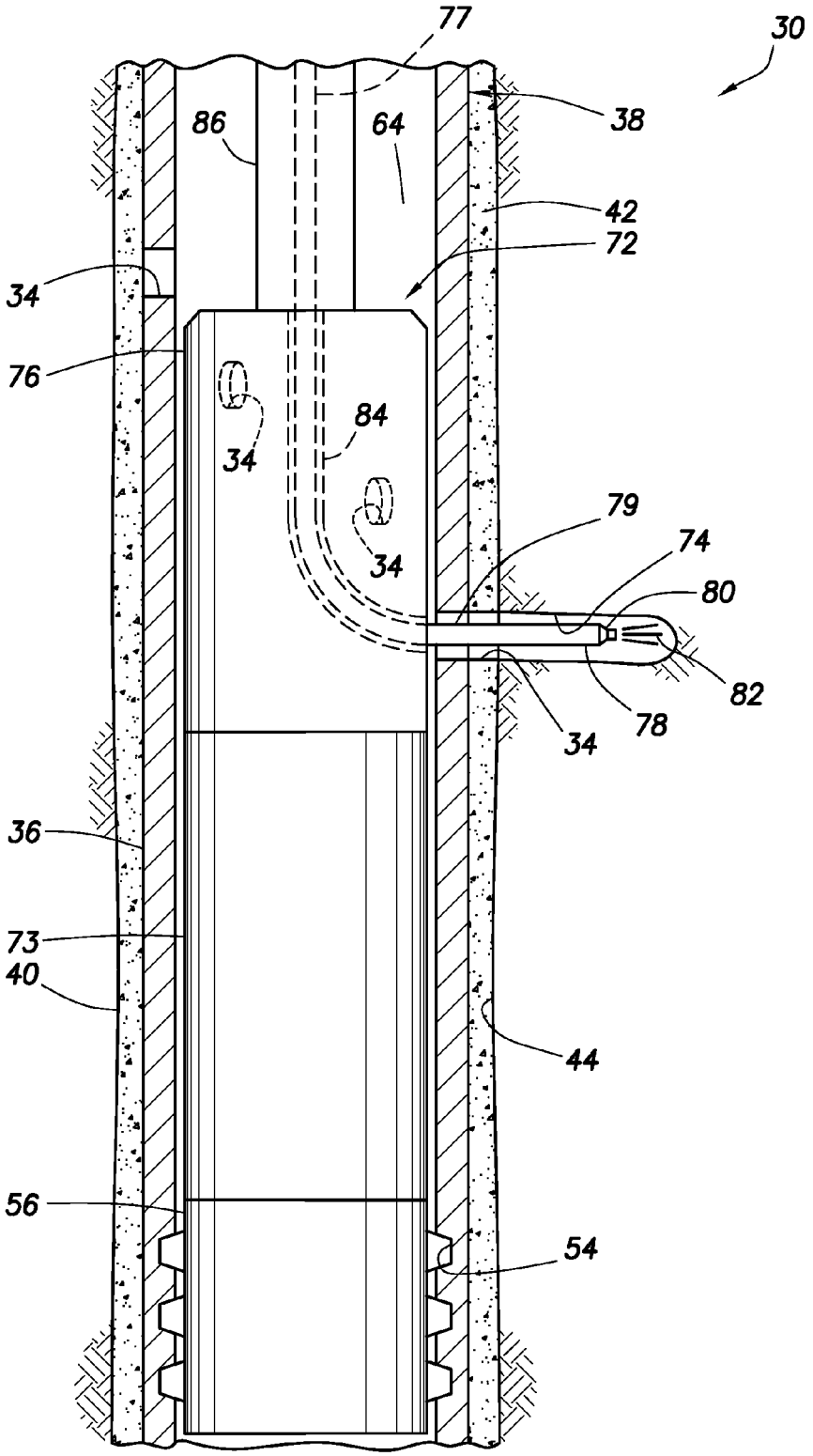
FIG. 12 is a schematic cross-sectional view of another system and method for drilling multiple lateral wellbores embodying principles of the present specification.

As described above, the indexing device 60 can also provide successive longitudinal displacements between its opposite ends, if desired. For example, it may be desired to longitudinally, as well as azimuthally, space apart the openings 34 relative to the casing section 36 in order to ensure competent zonal isolation between the openings 34 during and after jetting and/or radial drilling operations as depicted in FIGS. 5, 11 & 12.

Use of the orienting tool 56 and orienting device 54 in conjunction with the jet cutting assembly 32 has an additional benefit, in that it permits accurate longitudinal and azimuthal orienting of an ultra-short radius lateral wellbore drilling assembly (described more fully below) subsequently conveyed into the casing string 38. Specifically, the drilling assembly can be precisely aligned with the openings 34 due to the known orientation of the openings relative to the orienting device 54.

Figure 2A:
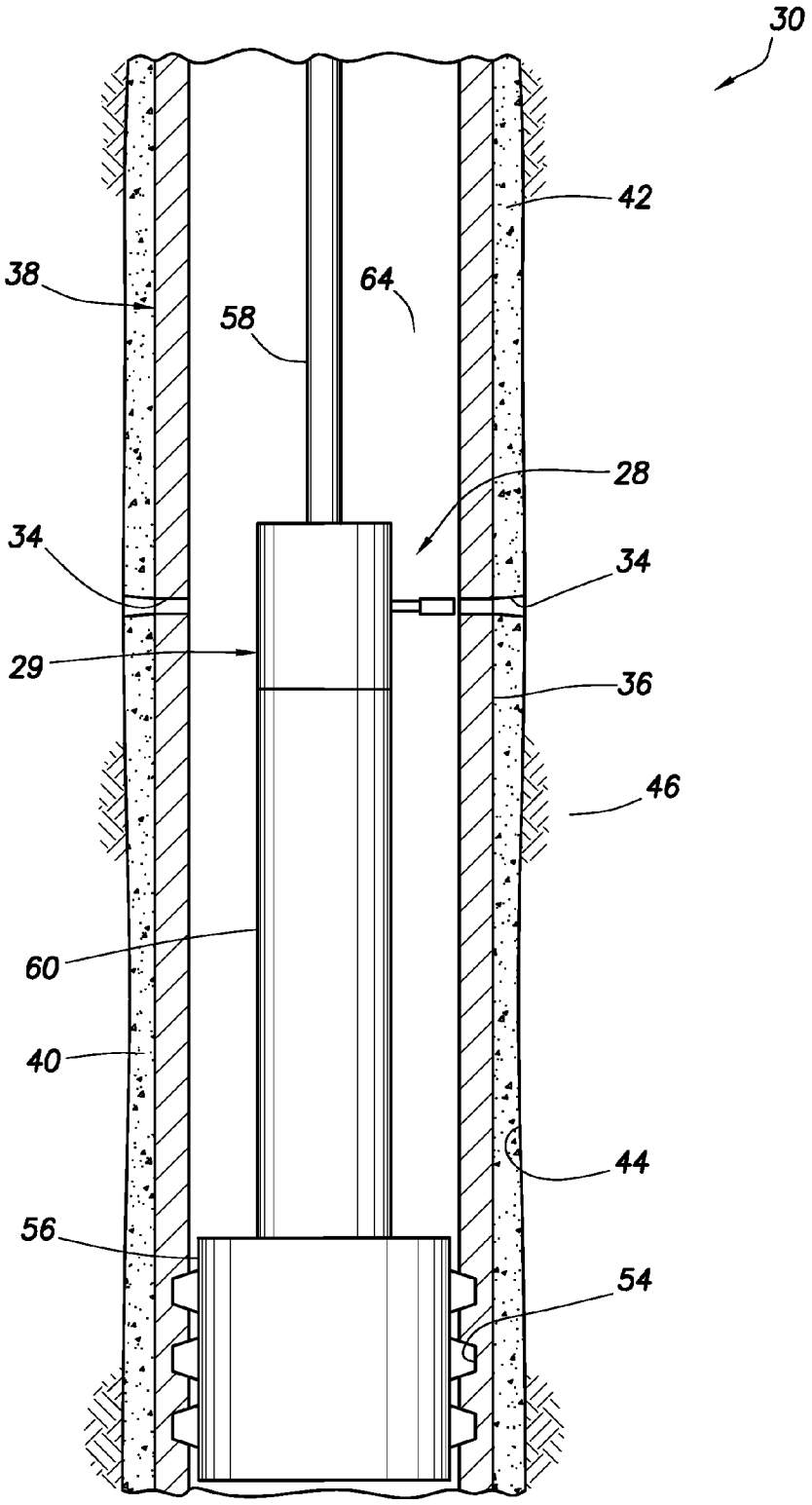
FIG. 2A is a schematic partially cross-sectional view of another system and method for forming the openings through the casing section sidewall.

Referring additionally now to FIG. 2A, another configuration of system 30 and associated method is representatively illustrated for drilling multiple lateral wellbores extending outwardly from a parent wellbore. In this alternative configuration, the tool used to create the openings 34 for the ultra-short radius lateral drilling is different compared to the configuration of FIG. 2. In FIG. 2A, rotary milling or coring-type cutting assembly 28 conveyed on the work string 58 is used to form openings 34 through the sidewall of the casing section 36, and through cement 40 external to the casing section.

For accurately positioning the rotary cutting assembly 28 both azimuthally and longitudinally relative to the casing section 36, the assembly is engaged with the orienting device 54 interconnected in the casing string 38 as was depicted in FIG. 2.

The rotary cutting assembly 28 includes the orienting tool 56 at its lower end, the azimuthal and/or longitudinal indexing device 60, and a rotary milling or coring device 29 at its upper end for milling or coring the openings 34 through the casing section 36 and cement 40. When the rotary cutting assembly 28 is conveyed into the casing string 38, the orienting tool 56 of the assembly cooperatively engages the orienting device 54, which thereby causes the rotary milling or coring device 29 to be azimuthally and longitudinally aligned with the desired locations for cutting the openings 34 in a manner similar to the system shown in FIG. 2.

A suitable rotary milling or coring device which may be used for cutting through the sidewall of casing 38 and the cement 40 is the RSCT™ Rotary Sidewall Coring Tool available from Halliburton Energy Services, Inc. of Houston, Tex. USA. However, it should be understood that other types of electric-powered rotary milling or coring devices may be used in keeping with the principles of the present disclosure.

The system 30 may include one or a multitude of casing sections 36 cemented in the parent wellbore 44 adjacent to a hydrocarbon-bearing zone targeted for one or more lateral wellbores using acid soluble cement 40. Each casing section 36 may include an associated orienting device 54 which is positioned with respect to the casing section to facilitate cutting openings 34 in the sidewall of the casing string 38 and cement 40 after the casing string is cemented in the parent wellbore 44 using the rotary sidewall coring or milling tool assembly 28.

The rotary sidewall coring or milling tool assembly 28 includes the orienting tool 56 at its lower end, the azimuthal and/or longitudinal indexing device 60, and the electric-line powered sidewall coring or milling device 29 at its upper end and is run inside the casing string 38 on the work string 58. Once the orienting tool 56 is temporarily attached to the orienting device 54 in the lowermost casing section 36, the rotary sidewall coring or milling device 29 is precisely positioned adjacent to the lowermost targeted reservoir and then the rotary sidewall coring or milling device is engaged to cut or mill a first opening 34 such that the exact longitudinal distance and azimuthal orientation between the orienting device and the first hole in the casing section is known.

After cutting or milling a first opening 34, the indexing device 60 is cycled to position the rotary sidewall coring or milling device 29 precisely adjacent to the next targeted casing exit opening 34 above the first opening 34 in the lowermost casing section 36. In a similar manner, additional casing exit openings 34 may be created in the lowermost casing section 36. The geometric dimensions of the rotary sidewall coring or milling assembly 28 together with the known location of the orienting device 54 in the lowermost casing section 36 will ensure the exact longitudinal distance and azimuthal orientation between the orienting device and each opening 34 contained within the lowermost casing section is known. This information will allow for the configuration of a diverter assembly similar to the one described above to facilitate the construction of one or multiple lateral wellbores through the openings 34 cut in the casing sections 36 using the previously described process.

Figure 2B:
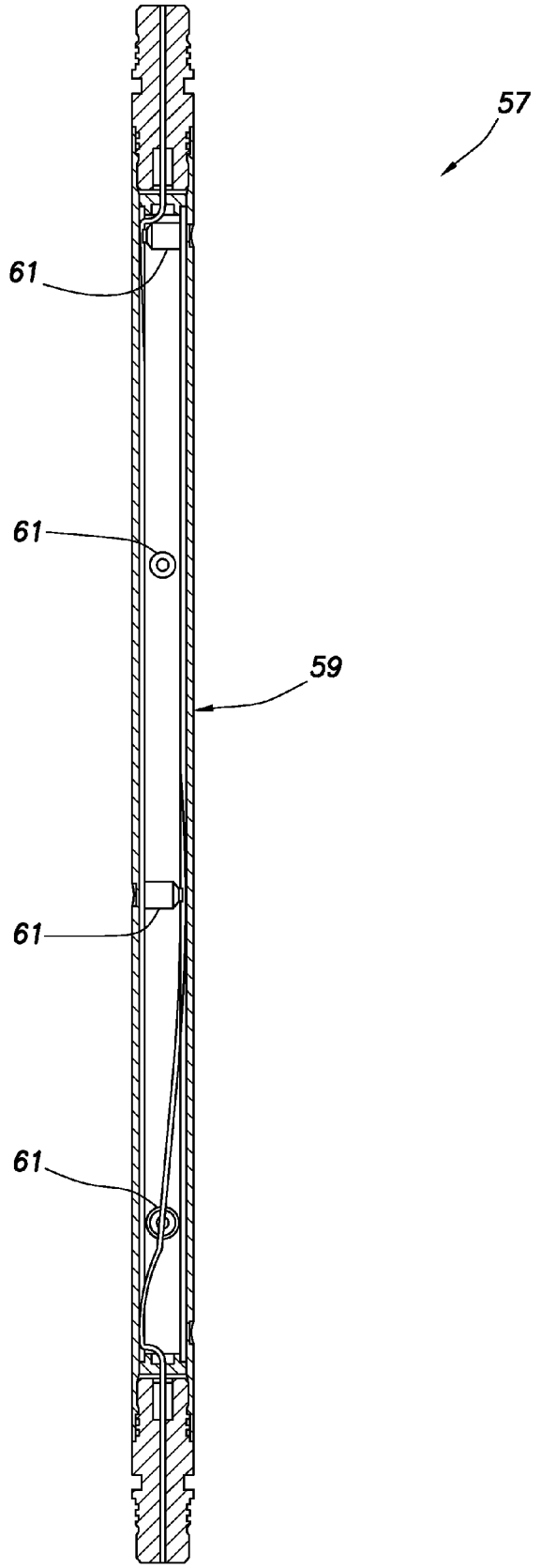
FIG. 2B is a schematic partially cross-sectional view of an alternate cutting assembly for forming the openings through the casing section sidewall.

Referring additionally now to FIG. 2B, another cutting device 57 which may be used in place of the jet cutting device 48 of FIG. 2 or the rotary cutting device 29 of FIG. 2A is representatively illustrated. The cutting device 57 differs from the other cutting devices 48, 29 described above, in that it comprises a perforating gun 59. Although not shown, the cutting device 57 would also preferably include a conventional firing head for actuating the perforating gun.

The perforating gun 59 includes "big hole" perforating charges 61 for forming the openings 34 through the casing section 36 and cement 40. As depicted in FIG. 2B, four of the charges 61 are azimuthally spaced apart by 90 degrees, and are longitudinally spaced apart by approximately 18 inches (45.7 cm). However, any number of charges 61, azimuthal orientation and longitudinal spacing may be used in keeping with the principles of this disclosure.

It will be appreciated that, due to the ability to azimuthally and longitudinally space apart the charges 61 of the perforating gun 59 as desired, the cutting assembly will not necessarily include the indexing device 60 described above. Instead, engagement of the orienting device 54 with the orienting tool 56 will preferably azimuthally and longitudinally align the perforating charges 61 with the desired locations for forming the respective openings 34 through the casing section 36 and cement 40, and detonation of the perforating gun 59 will cause the openings to be simultaneously formed.

Figure 3:
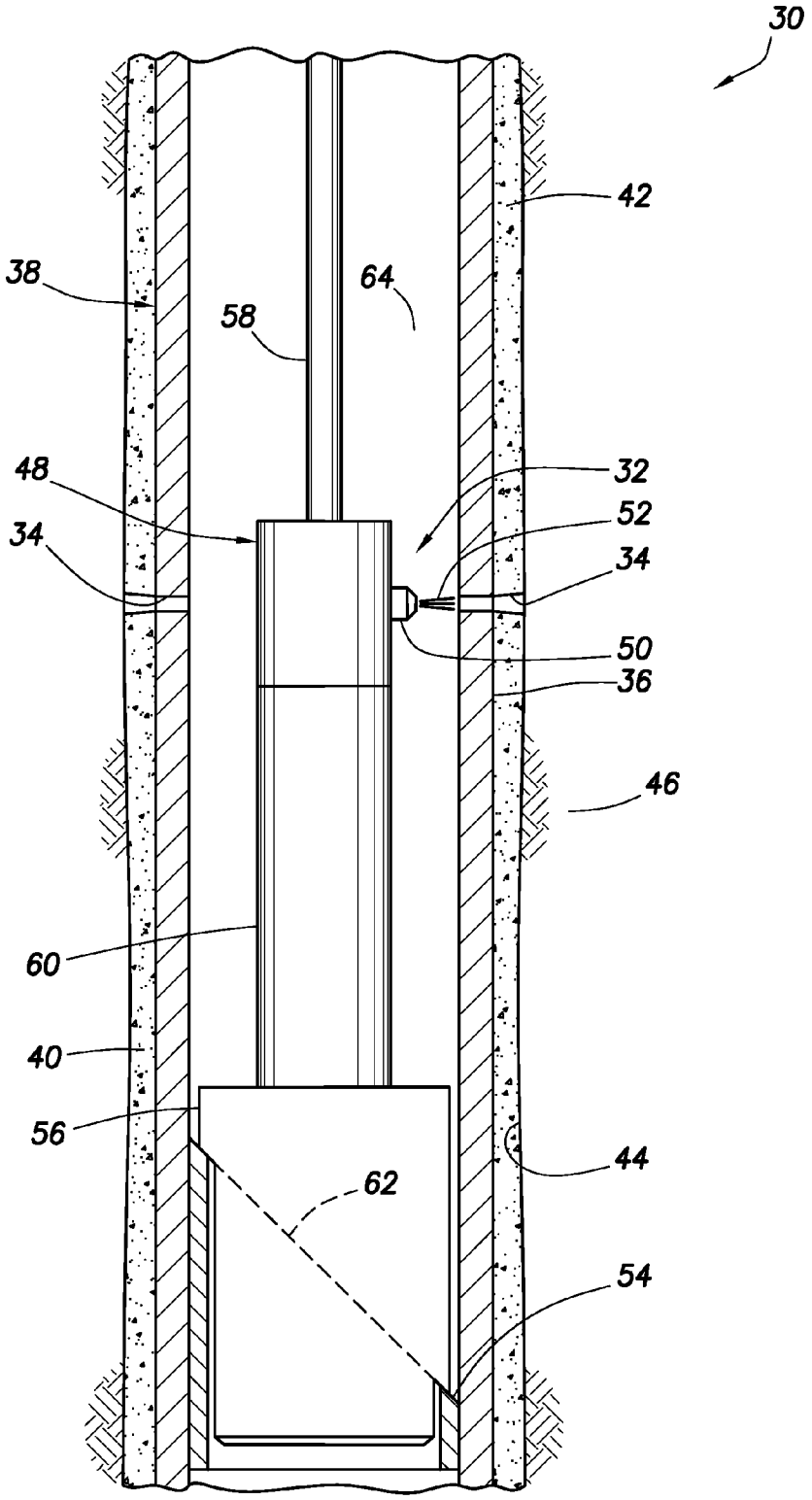
FIG. 3 is a schematic partially cross-sectional view of yet another system and method for forming the openings through the casing section sidewall.

Referring additionally now to FIG. 3, another configuration of the system 30 and associated method is representatively illustrated in which the orienting device 54 and the orienting tool 56 are of somewhat different types as compared to the configuration of FIG. 2. Specifically, the orienting device 54 and orienting tool 56 are of the type known to those skilled in the art as "muleshoes," in that they include mating longitudinally inclined orienting profiles 62 which serve to azimuthally orient the jet cutting assembly 32 relative to the casing section 36. Such cooperative engagement between the profiles 62 also serves to longitudinally align the jet cutting device 48 with the desired locations for forming the openings 34.

The orienting device 54 may be secured in position within the casing section 36 when the parent wellbore 44 is initially cased. Alternatively, the orienting device 54 may be subsequently conveyed into the casing string 38 and secured therein, for example, by use of an anchoring device. In either case, the orienting device 54 (and any anchoring device) may be made of a relatively easily drillable material (such as aluminum, composite material, or low carbon steel) to facilitate removal after lateral drilling operations are concluded and so that flow and access through an internal flow passage 64 of the casing string 38 will not be restricted after the lateral wellbore drilling operations. A benefit of this unrestricted access through internal flow passage 64 is to allow for the installation of a downhole pump of an artificial lift system upon conclusion of lateral drilling operations and/or fracture stimulation operations at a location in the well of system 30 below all lateral wellbores.

Figure 4:
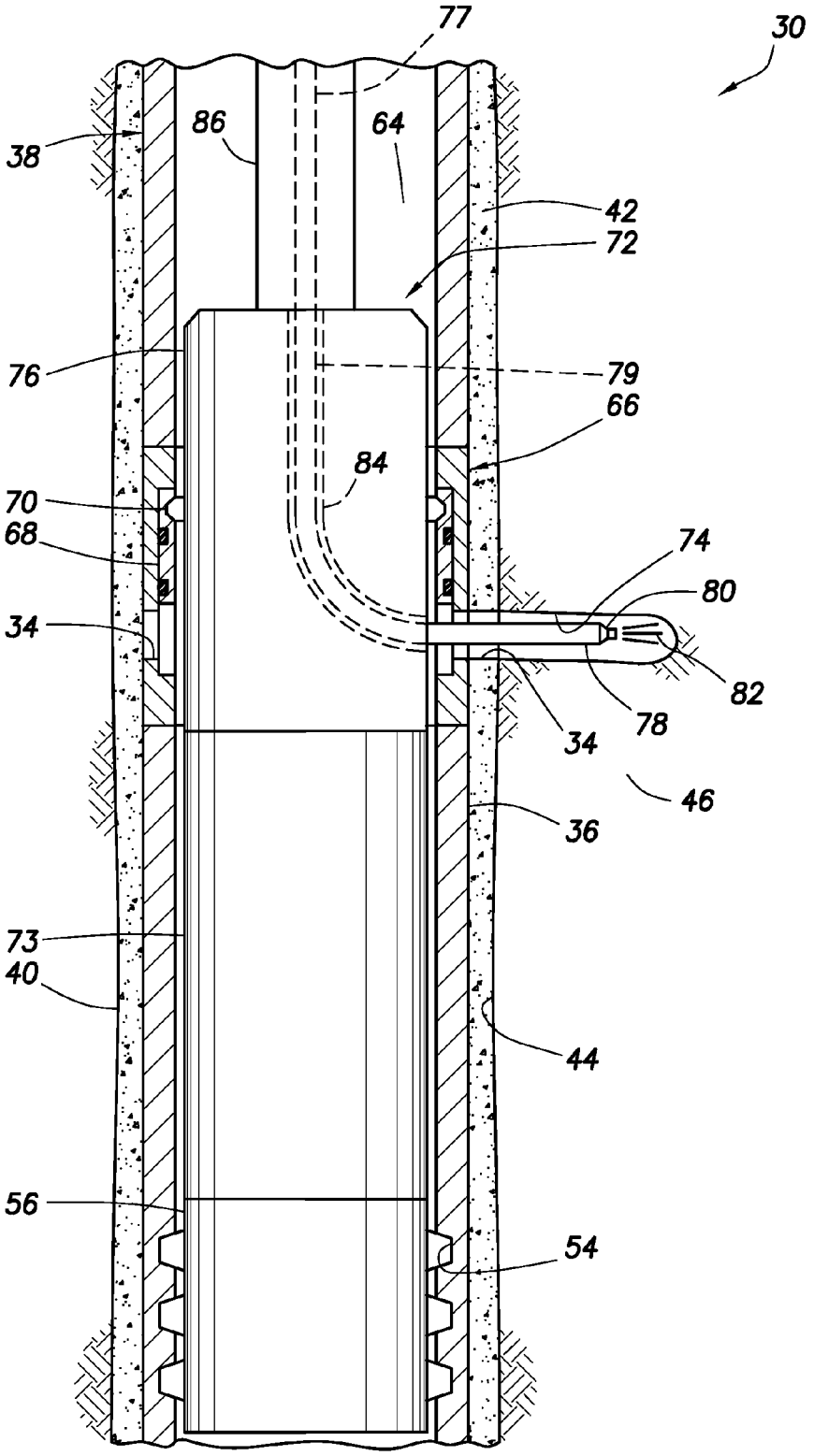
FIG. 4 is a schematic partially cross-sectional view of a system and method for drilling multiple lateral wellbores embodying principles of the present specification.

Referring additionally now to FIG. 4, another configuration of the system 30 and associated method is representatively illustrated. In this configuration, a jet cutting assembly is not used to form the openings 34 through the sidewall of the casing section 36. Instead, the openings 34 are formed through the sidewall of a valve device 66 interconnected as part of the casing string 38.

The valve device 66 is depicted in FIG. 4 as being a sliding sleeve type of valve, but other types of valves may be used if desired. The valve device 66 includes a closure device 68 in the form of a sleeve which is displaceable to selectively permit or prevent access and fluid flow through the openings 34.

The closure device 68 may be displaced by means of shifting lugs or dogs 70 carried on a diverter assembly 72 conveyed into the casing string 38. However, it should be understood that any means of displacing the closure device 68 may be used in keeping with the principles of this disclosure.

The diverter assembly 72 is used to drill multiple lateral wellbores 74 extending outwardly from the parent wellbore 44. For this purpose, the diverter assembly 72 includes the orienting tool 56 for cooperative engagement with the orienting device 54, an indexing device 73 for azimuthally and/or longitudinally indexing a diverter device 76 into alignment with successive ones of the openings 34, and a drilling assembly 78 which is diverted by the diverter device from the parent wellbore 44 through the openings.

As used herein, the terms "drilling," "drill" and similar terms indicate cutting operations which do not necessarily require rotation of a drill bit. For example, "drilling" can include jet cutting, and a drilling assembly can include a jet cutting tool.

The indexing device 73 may be similar to the indexing device 60 described above, such that the indexing operation may be performed by hydraulic or mechanical means. Other types of indexing devices may be used for the device 73 in keeping with the principles of this disclosure.

Preferably, the indexing device 73 is positioned between the orienting tool 56 and the diverter device 76. In this manner, the cooperative engagement of the diverter assembly 72 with the orienting profile of orienting device 54 can function to azimuthally and longitudinally align the diverter device 76 and drilling assembly 78 with a first one of the openings 34, and thereafter the indexing device 73 can be operated to azimuthally and/or longitudinally align the diverter device and drilling assembly with successive additional openings in valve device 66.

As described above, the indexing device 73 can also function to longitudinally align the diverter device 76 and drilling assembly 78 with each of the openings 34. For example, if the openings 34 are longitudinally spaced apart, operation of the indexing device 73 can serve to longitudinally displace the diverter device 76 as it is also azimuthally displaced between alignments with successive openings in valve device 66.

As depicted in FIG. 4, one of the ultra-short radius lateral wellbores 74 is being drilled or jetted using the drilling assembly 78 which has been deflected through one of the openings 34. The drilling assembly 78 includes a nozzle 80 and a high pressure flexible hose 79 conveyed with high pressure coiled tubing 77 for ejecting a cutting fluid 82 to thereby jet cut through the cement 40 and the formation 46 surrounding the parent wellbore 44. A suitable ultra-short radius jetting system which may be used for jetting lateral wellbores 74 is available from Radial Drilling Services, Inc. of Houston, Tex. USA.

The fluid 82 may comprise an acidic component to at least partially dissolve the cement 40 and facilitate extending the opening 34 through the cement 40 and the formation 46. However, unlike the fluid 52 described above, the fluid 82 preferably does not include any abrasive material, since nozzle 80 is not typically designed for use with abrasive materials due to the potential for plugging the small diameter jets of nozzle 80. But it should be understood that abrasive materials could be used with the fluid 82, and that other types of drilling tools may be used, in keeping with the principles of this disclosure.

For example, instead of the nozzle 80 for ejecting the fluid 82 to jet cut through the formation 46, the drilling assembly 78 could instead include a drill bit and a drill motor or turbine to rotate the drill bit for drilling and/or jetting a lateral wellbore 74 through the formation 46. Any means of drilling through the formation 46 to form the lateral wellbores 74 may be used in keeping with the principles of this disclosure.

Preferably, the lateral wellbore 74 shown in FIG. 4 is drilled or jetted at least 100 feet (30.5 m) outward from the parent wellbore 44, and may be drilled or jetted several hundred feet (100 m or more). During or subsequent to the initial jetting or drilling of a lateral wellbore 74, the lateral hole size and/or shape may be intentionally adjusted (i.e., donut-shaped or notched recesses) by varying the jetting time and/or jet nozzle 80 configuration at different points along the length of the lateral wellbore to promote the preferential hydraulic fracture initiation at these enlarged points along the lateral length.

Figure 4A:
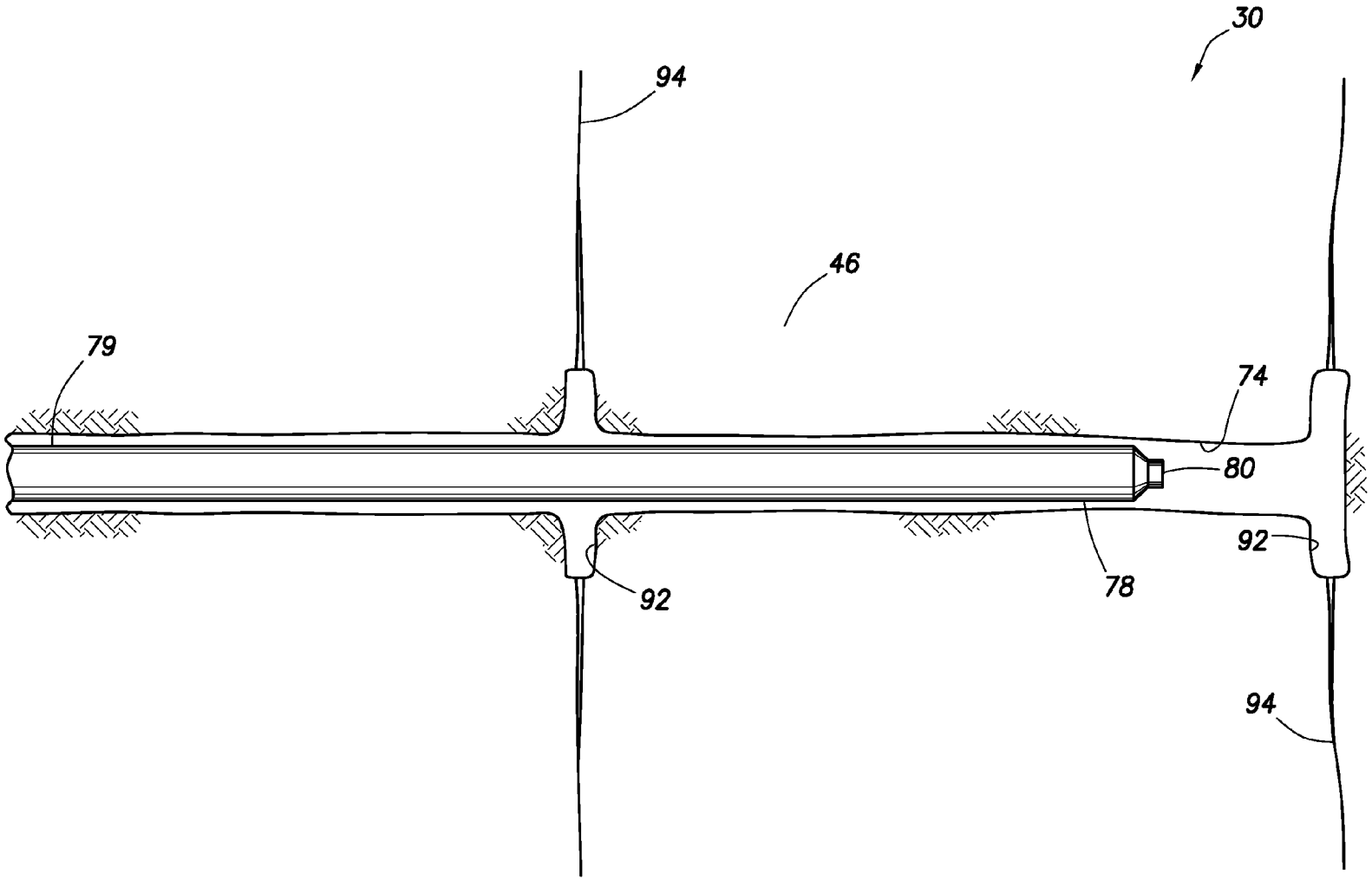
FIG. 4A is a schematic partially cross-sectional view of the system and method of FIG. 4 with fracture initiations formed along a lateral wellbore.
Figure 20:
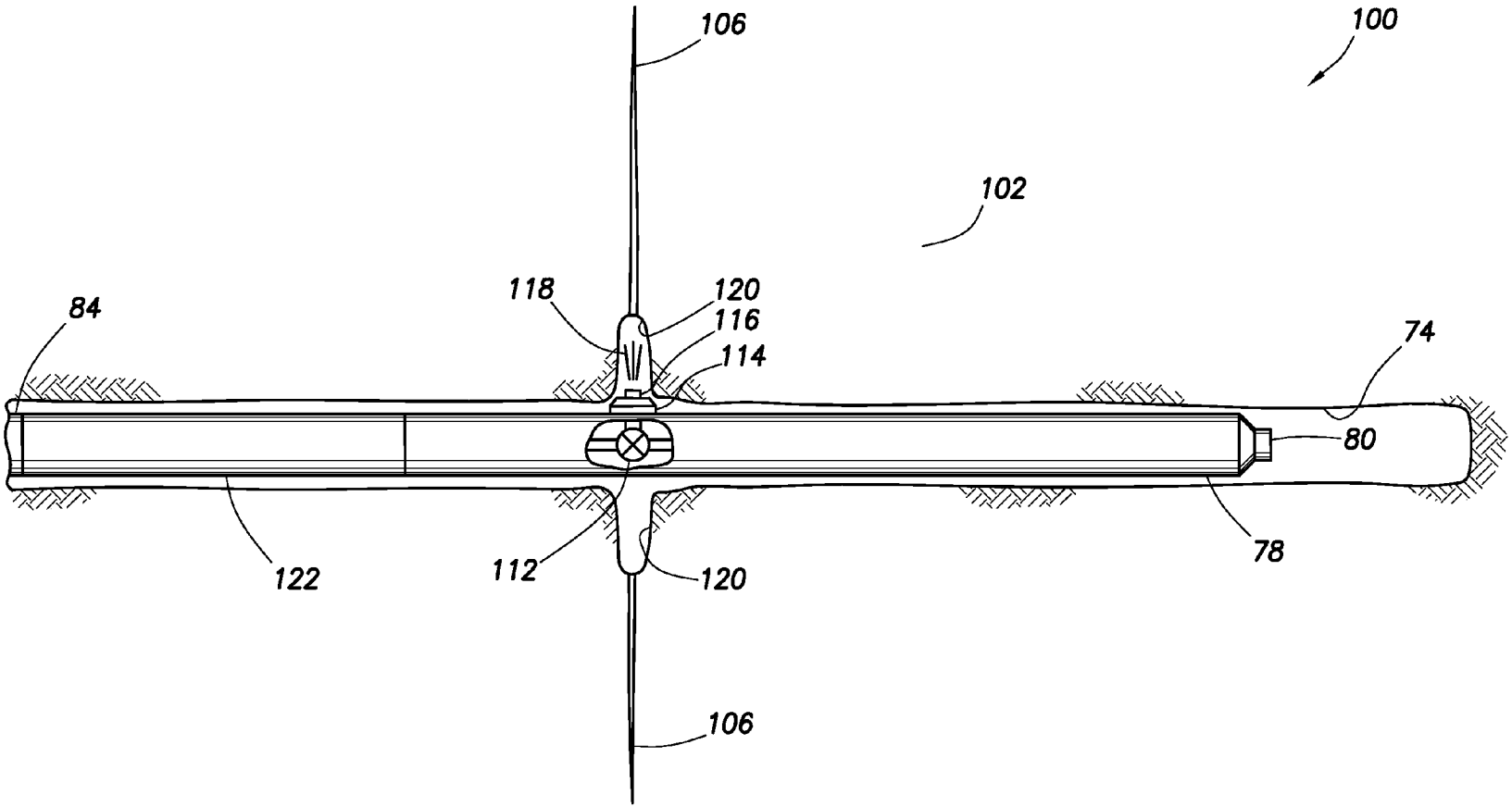
FIG. 20 is a schematic partially cross-sectional view of a system and method of drilling and stimulating a lateral wellbore embodying principles of the present specification.

As depicted in FIG. 4A, donut-shaped fracture initiations 92 have been formed along the length of the lateral wellbore 74 as described above. These fracture initiations 92 serve to promote formation of fractures 94 in the formation 46. Somewhat similar notched recesses or fracture initiations 120 are depicted in FIG. 20 and are described more fully below.

Thus, the method associated with the system 30 may include varying the profile (i.e., hole size and/or shape) along the length of each lateral wellbore 74 to optimize the distribution of hydraulic fracture energy along the length of each lateral wellbore during a fracture stimulation treatment. The lateral wellbore size and shape along the length of each lateral wellbore may be purposely adjusted by varying the jetting time and/or jet nozzle configuration at different points along the length of the lateral wellbore either during the initial lateral wellbore construction process or subsequent to jetting the original lateral wellbore.

Using this method, friction pressure losses may be purposely managed along the length of each lateral wellbore 74 and/or fracture initiations 92, 120 may be intentionally created at specific locations within each lateral wellbore. Optimizing the distribution of hydraulic fracture energy and creating certain fracture initiations 92, 120 or breakdown points along the length of each lateral wellbore 74 will improve the efficiency and effectiveness of the fracture stimulation treatments which target each lateral wellbore and maximize the stimulated reservoir volume of each targeted reservoir, thus promoting maximum recovery of hydrocarbons contained in the reservoirs.

After drilling the first lateral wellbore 74 and optionally adjusting the hole size and/or shape along the lateral length, the drilling assembly 78 is withdrawn from that lateral wellbore, the indexing device 73 is operated to align the diverter device 76 with another one of the openings 34, and then another lateral wellbore is drilled or jetted through that opening. This process is repeated until a desired number of lateral wellbores 74 have been drilled or jetted through the openings 34 of the valve device 66.

After the lateral wellbores 74 have been drilled or jetted, the diverter assembly 72 may be retrieved from the well, or it may be repositioned in the parent wellbore 44 in order to drill another set of lateral wellbores into another formation or zone. For this purpose, the casing string 38 may have multiple orienting devices 54 interconnected therein, or one or more orienting devices may be secured in the casing string at different locations using respective one or more anchoring devices, etc.

One additional benefit of using the valve device 66 to provide the openings 34 through the sidewall of the casing section 36 is that the valve device can be selectively opened and closed after the lateral wellbores 74 have been drilled. This may be useful to control stimulation and/or production operations when, for example, it may be desired to selectively permit or prevent access or fluid communication through all, or less than all, of the openings 34.

As described above, drilling assembly 78 may be conveyed through pathway 84 of device 76 via a coiled tubing string 77 from a remote location, such as the earth's surface. However, other means of delivering the drilling assembly 78 to the openings 34 for drilling the lateral wellbores 74 may be used in keeping with the principles of this disclosure.

Referring additionally now to FIG. 5, another construction of the valve device 66 and its closure device 68 is representatively illustrated apart from the remainder of the system 30. In this construction, the closure device 68 is rotated, rather than displaced longitudinally, to selectively permit and prevent access and fluid communication through the openings 34.

In FIG. 5, the valve device 66 is depicted from an interior thereof (e.g., from the passage 64 in the system 30), with the valve "unrolled" to show a two-dimensional view. The closure device 68, thus, is shown as having a rectangular shape, whereas in actual practice it would preferably have a hollow cylindrical shape.

The valve device 66 includes four of the openings 34, which are spaced apart both azimuthally and longitudinally. For example, the openings 34 may be azimuthally spaced apart by 90 degrees. Of course, any number of openings 34 and/or azimuthal and longitudinal spacing may be used, as desired.

The vertical dashed lines in FIG. 5 represent rotational positions of the closure device 68. In this embodiment, the closure device 68 has sixteen rotational or azimuthal positions relative to the openings 34.

Ports 88 are formed through the closure device 68 at predetermined azimuthal and longitudinal positions, with the ports having predetermined circumferential lengths. These positions and lengths are predetermined based on a pattern which will permit the openings 34 to be selectively opened or closed in any desired combination.

This is a substantial benefit as compared to the valve device 66 of FIG. 4, in which all of the openings 34 are either opened or closed together. By providing the ability to selectively open and close different combinations of the openings 34, additional control is afforded over the ability to access and flow fluid through the individual openings.

As depicted in FIG. 5, the uppermost opening 34 can be opened by displacing the closure device 68 to the left one position. The other openings 34 remain closed in this position of the closure device 68. To open both of the two uppermost openings 34, the closure device 68 can be displaced another position to the left. The two lowermost openings 34 remain closed in this position of the closure device 68.

To open the middle two openings 34, the closure device 68 can be displaced another position to the left. The uppermost and lowermost two openings 34 will be closed in this position of the closure device 68. It will be appreciated that the sixteen different positions of the closure device 68 correspond to the sixteen possible combinations and individual ones of the openings 34.

FIGS. 6-11 representatively illustrate various different ways in which the openings 34 can be provided in the casing section 36 in a manner which permits ease of milling or drilling through the sidewall of the casing section and cement 40. In some cases, the jet cutting device 48 depicted in FIGS. 2 & 3 could be used to open the openings 34, and in other cases the drilling assembly 78 depicted in FIG. 4 (comprising, for example, a jet cutting nozzle or a rotatable drill bit) could be used to exit through the openings in valve 66 in order to drill or jet through the cement 40.

Figure 6:
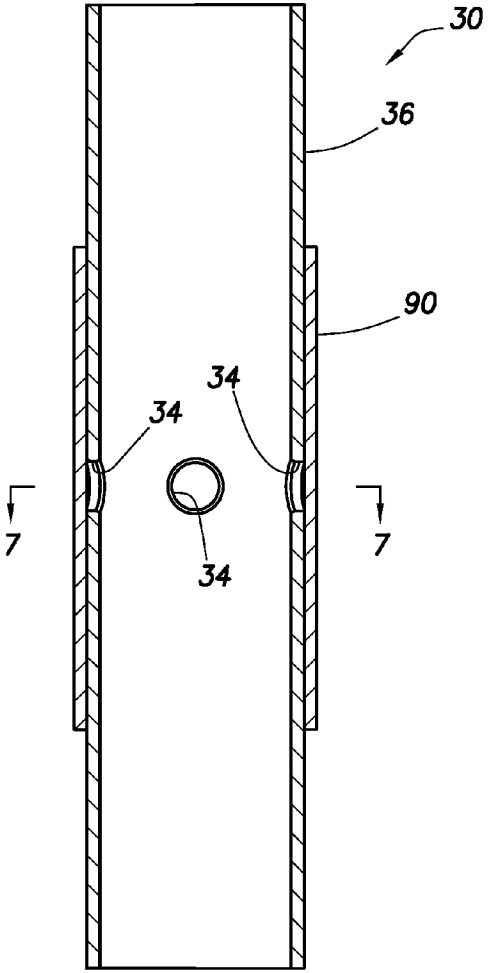

In FIG. 6, the openings 34 are pre-formed (i.e., via a machining process prior to running casing section 36 into system 30) through the sidewall of the casing section 36, but are closed off by an external sleeve or other type of barrier 90. The barrier 90 is preferably made of an easily drilled, milled or acid-soluble material (e.g., aluminum, composite material, etc.) for ease of unblocking the openings 34 when desired. However, prior to drilling, milling or dissolving through the barrier 90, it beneficially prevents debris from entering the casing section 36, allows for washing the casing string 38 into the wellbore 44, and provides hydraulic isolation during primary cementing operations.

Figure 7:
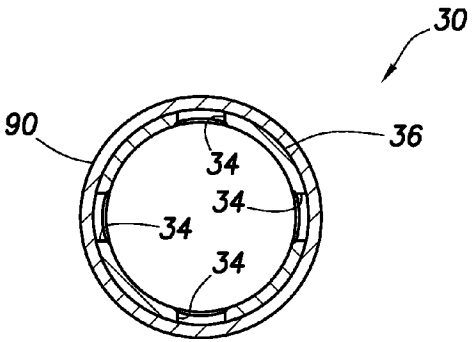
FIGS. 6-11 are schematic cross-sectional views of casing sections which may be used in the multiple lateral wellbores drilling systems and methods.

In FIG. 7, a cross-sectional view of the casing section 36 of FIG. 6 is depicted, taken along line 7-7 of FIG. 6. In this view it may be seen that four of the openings 34 are azimuthally spaced apart by 90 degrees, and are longitudinally aligned.

However, as discussed above, any number and azimuthal spacing of the openings 34 can be used. The openings 34 could also be longitudinally spaced apart if desired, for example, to prevent compromising the isolation provided by the cement 40 between the individual lateral wellbores 74 during drilling, stimulation, completion and production operations.

Note that an interior periphery of each of the openings 34 is preferably chamfered or beveled to provide a seating surface. As discussed more fully below, plugging devices can be used to selectively block flow into the openings 34 during stimulation operations. The seating surfaces on the peripheries of the openings 34 will enhance sealing of the plugging devices against the interior of the casing section 36.

Figure 8:
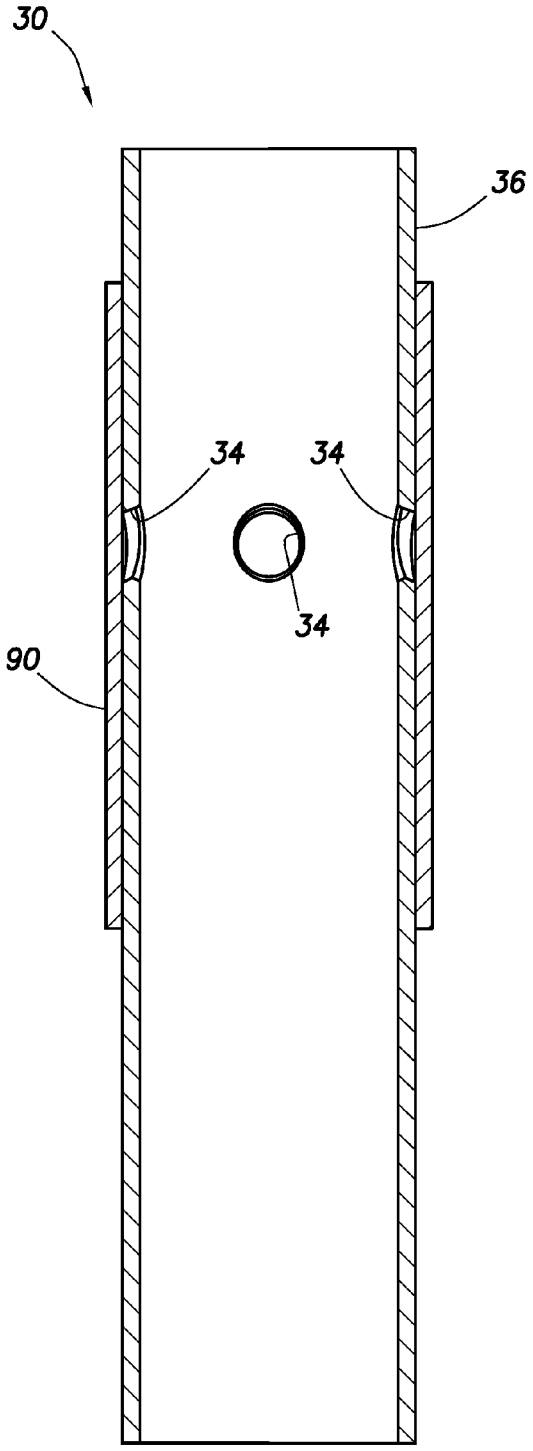

In FIG. 8, the casing section 36 is similar to that of FIG. 6, but the openings 34 are inclined (angled) relative to a longitudinal axis of the casing section. This configuration facilitates deflecting the drilling assembly 78 through the openings 34, and may be used to incline the lateral wellbores 74 relative to the parent wellbore 44.

Figure 9:
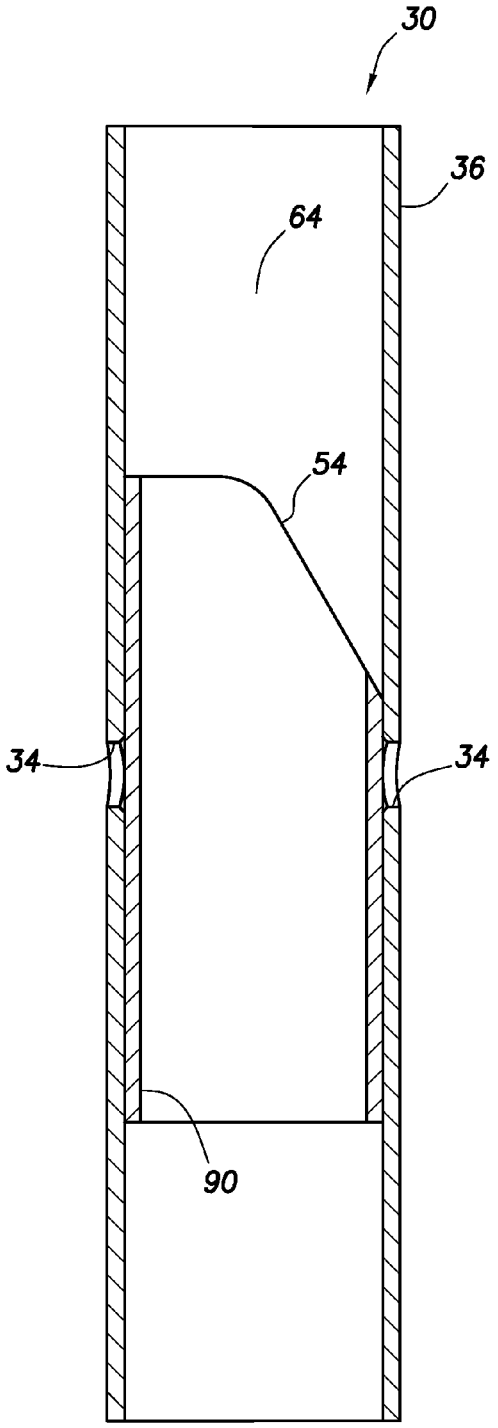

In FIG. 9, the barrier 90 is internal to the casing section 36. In addition, the barrier 90 is combined with the orienting device 54 (in this case having a muleshoe-type inclined orienting profile similar to that depicted in FIG. 3) for longitudinally and azimuthally orienting a diverter assembly (such as the diverter assembly 72 of FIG. 4) relative to the casing section 36. After the lateral wellbores 74 have been drilled through the openings 34, the barrier 90 and orienting device 54 can be drilled out or dissolved to provide enlarged access and flow through the passage 64.

Figure 10:
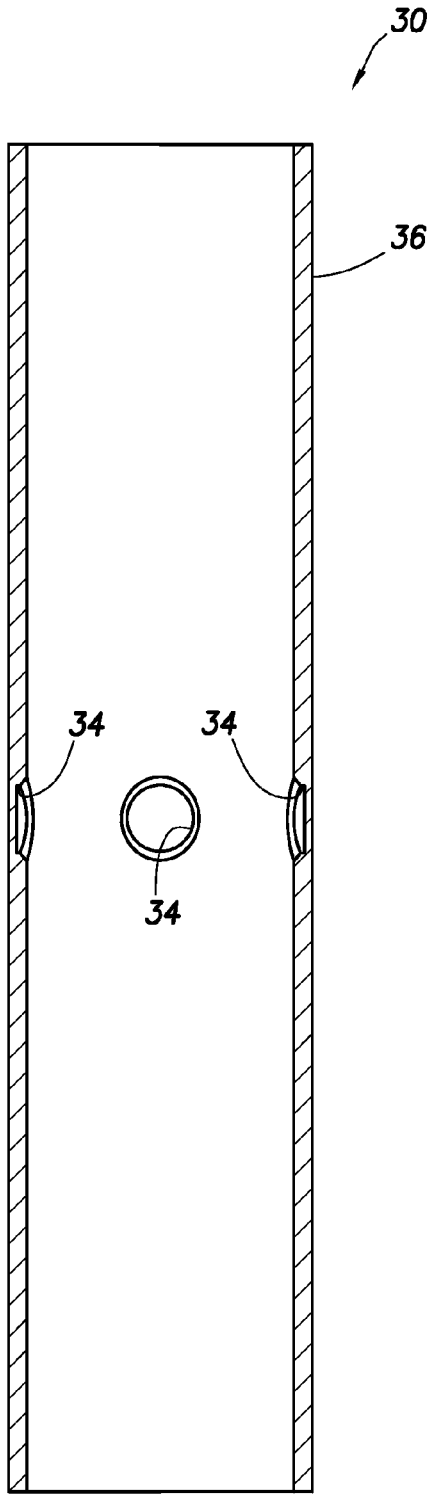

In FIG. 10, the openings 34 are only partially formed through the sidewall of the casing section 36. This configuration provides for speeding up the process of drilling through the casing section 36, without requiring the use of an additional barrier or increasing the thickness of the casing section sidewall.

In FIG. 11, the openings 34 are positioned in the same azimuthal plane, but are longitudinally spaced apart. In addition, the orienting device 54 is integrally formed in the same casing section 36 as the openings 34, thereby providing for precise machining of the azimuthal and longitudinal relationships between these elements.

In other embodiments, the orienting device 54 and openings 34 could be formed in different sections of casing. In that case, connections between these different casing sections would preferably be of the type which provide for accurate azimuthal alignment when the sections are connected to each other. For example, certain threaded connections (such as stub Acme, etc.) provide positive and repeatable shoulder-to-shoulder makeup. In this manner, the precise azimuthal and longitudinal relationship between the openings 34 and the orienting device 54 can be conveniently determined prior to installing the casing string 38, even though these elements are formed in different portions of the casing.

In other embodiments, the barrier 90 could be in forms other than a sleeve. For example, the barrier 90 could be in the form of a hollow plug in each of the openings 34, with the plugs extending into the interior of the casing string 38. To open the openings 34, the portions of the plugs in the interior of the casing string 38 can be broken off. Thus, it should be appreciated that any type of barrier may be used in keeping with the principles of this disclosure.

Referring additionally now to FIG. 12, another configuration of the system 30 and associated method is representatively illustrated. In this configuration, the openings 34 are both azimuthally and longitudinally spaced apart in the casing section 36. Thus, after drilling a first one of the lateral wellbores 74, operation of the indexing device 73 will function to both azimuthally and longitudinally displace the diverter device 76, so that the drilling assembly 78 is then properly aligned with the next successive opening 34. This process is repeated for each of the subsequent openings 34.

Note that, in FIG. 12, the openings 34 are already formed through the sidewall of the casing section 36. This could be the case, for example, if a barrier 90 was previously used to plug off the openings 34, and then (e.g., after the cementing operation) the barrier was dissolved, drilled out or otherwise removed prior to the drilling operation. However, it should be understood that the openings 34 may be provided in the casing section 36 by any means (including, for example, jet cutting through the casing section sidewall, drilling through the casing section sidewall, etc.) before, after or during the drilling operation in keeping with the principles of this disclosure.

Referring additionally now to FIGS. 13-19, various configurations of a system 100 and associated methods for stimulating formations and/or zones intersected by the lateral wellbores 74 are representatively and schematically illustrated. These systems and methods can take advantage of the characteristics and benefits of the system 30 and associated methods described above to enhance production and/or injection of fluid into or out of the lateral wellbores 74.

Figure 13:
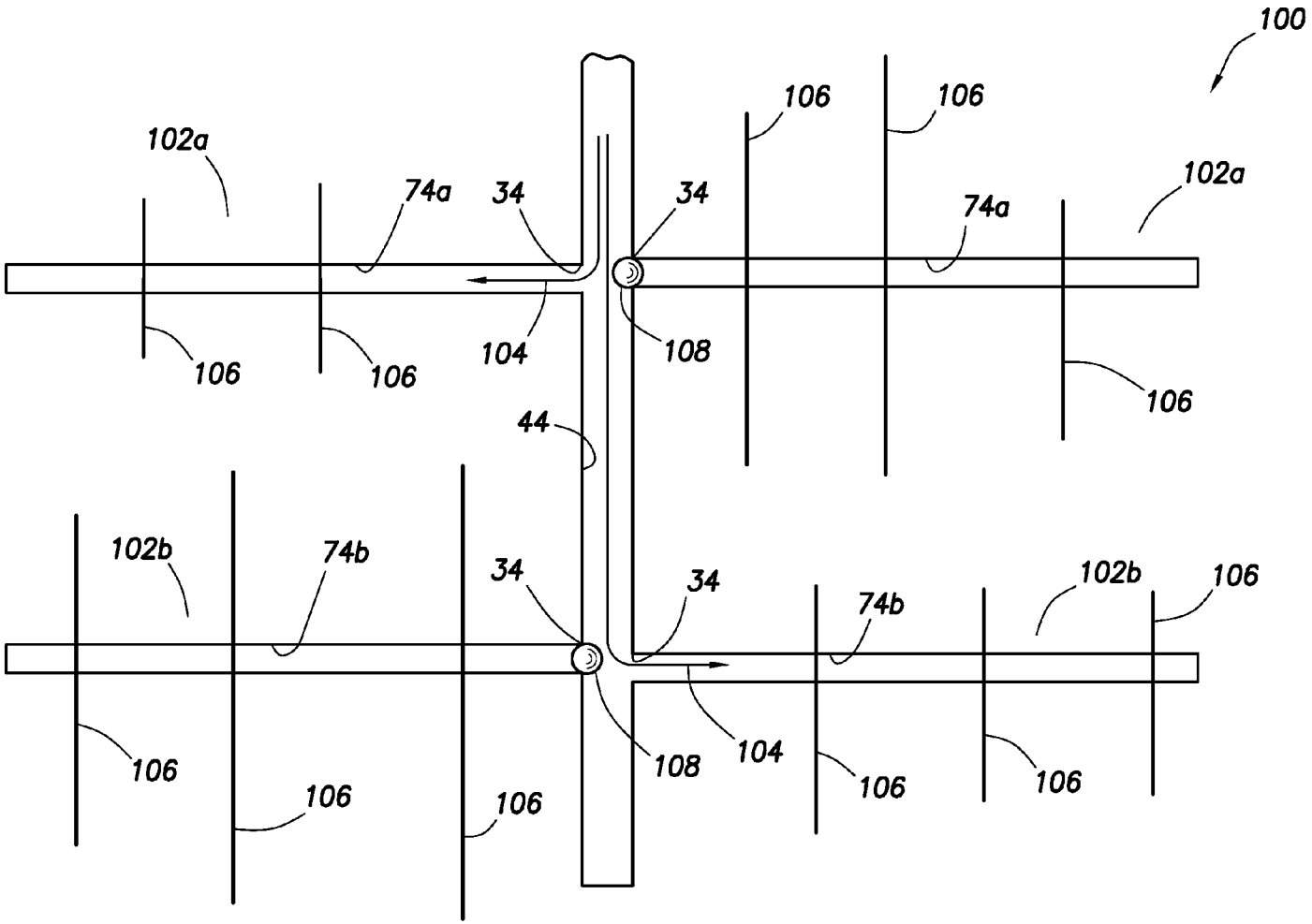
FIGS. 13-19 are schematic well system diagrams illustrating systems and methods for stimulating multiple lateral wellbores embodying principles of the present specification.

In FIG. 13, one set of lateral wellbores 74*a* has been drilled outwardly from the parent wellbore 44 into a zone 102*a*. At another location along the parent wellbore 44, another set of lateral wellbores 74*b* has been drilled outward into another zone 102*b*.

It is desired to fracture the zones 102*a, b* surrounding each of the respective lateral wellbores 74*a, b* in order to stimulate the zones. In addition, time and cost savings can be realized if the fracturing can be accomplished from each of the lateral wellbores 74*a, b* at the same time, or at least during the same stimulation operation.

However, the stimulation fluid 104 will preferentially flow into the first ones of the lateral wellbores 74*a, b* having the lowest fracture pressure requirement (e.g., formation rock strength, natural fracturing, formation pressure or other characteristics, which will promote the preferential initiation of a hydraulic fracture) which will prevent or at least retard formation of fractures from the remaining lateral wellbores. To remedy this situation, plugging devices 108 (such as degradable diverter balls, etc.) can be released into the parent wellbore 44 to close off those openings 34 through which the stimulation fluid 104 is preferentially flowing, as depicted in FIG. 13.

With these openings 34 closed off, the stimulation fluid 104 will then flow into the lateral wellbores 74*a, b* from which sufficient fractures 106 have not yet been formed. As described above, the openings 34 can be shaped or configured to more readily sealingly receive the plugging devices 108.

Thus, upon completion of the lateral wellbores 74*a, b* construction process, the geometry of the machined hole openings 34 in the casing sections 36 will allow for sequential fracture stimulation treatments using degradable, spherically-shaped ball sealers or other plugging devices 108 which are sized slightly larger than the diameter of the hole openings in the casing sections. In this sequential fracture stimulation process, the plugging devices 108 are released into the stimulation fluids 104 from a location above the targeted lateral wellbores 74*a, b* (i.e., from the surface) in stages to intentionally divert stimulation fluids which are being predominately injected into a particular lateral wellbore into one or more additional lateral wellbores.

For example, if eight lateral wellbores 74 extending from a parent wellbore 44 are to be stimulated using this process, approximately seven plugging devices 108 would be used to divide each of eight fracture stimulation stages. This sequential fracture stimulation process is intended to ensure each lateral wellbore 74 is effectively stimulated and to promote the alteration of the effective in-situ stress state in the targeted zones 102 in near real-time, thus promoting the creation of highly productive complex induced fracture systems.

Figure 14:
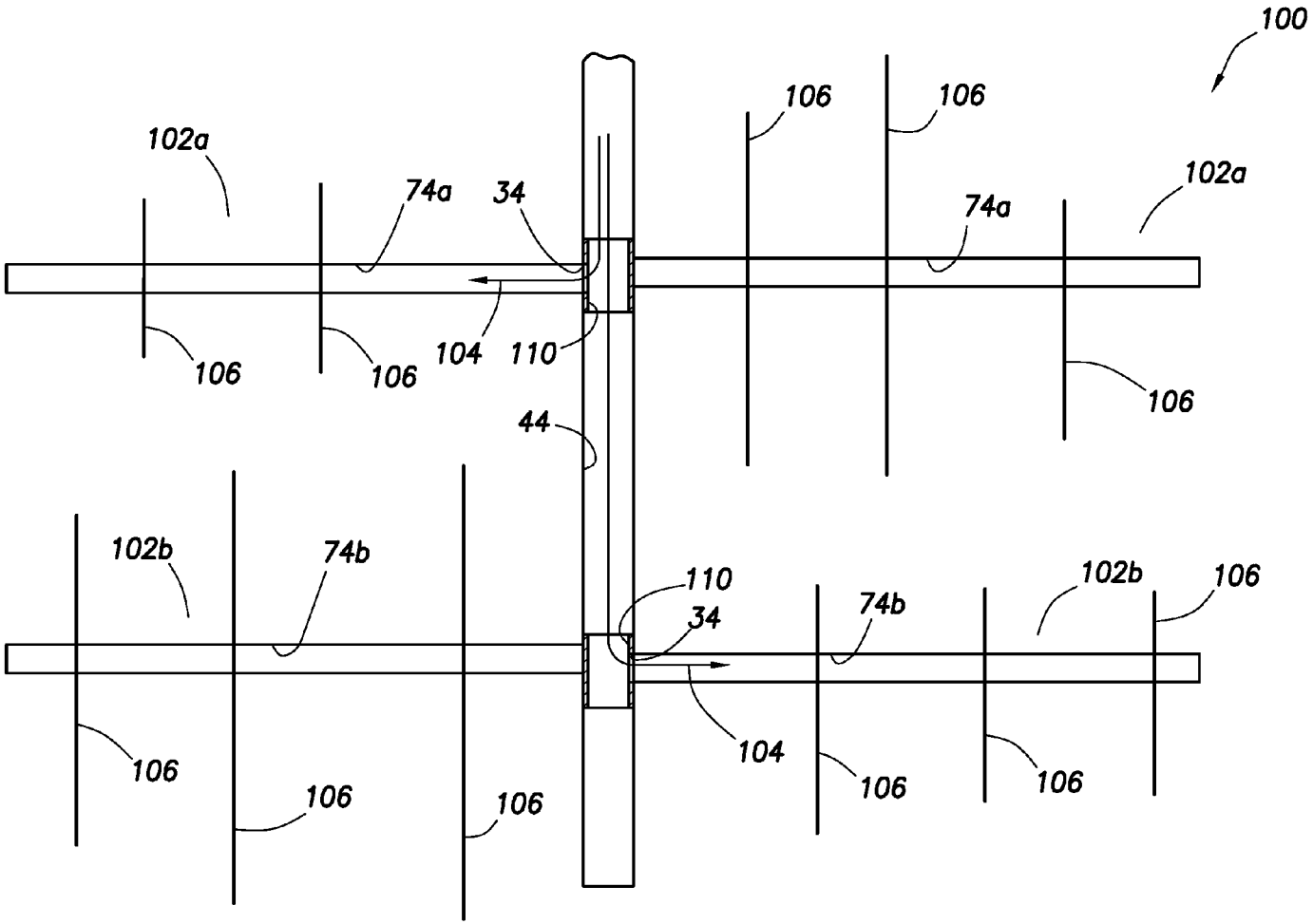

Referring additionally now to FIG. 14, another configuration of the system 100 is representatively illustrated. This configuration is similar to that of FIG. 13, except that instead of the plugging devices 108, flow diversion sleeves 110 are positioned in the parent wellbore 44 and used to selectively permit and prevent fluid communication with each of the lateral wellbores 74*a, b*.

The diversion sleeves 110 could, for example, be the same as or similar to the valve device 66 depicted in FIG. 5. The lateral wellbores 74*a, b* could have been drilled through the openings 34 in the valve device 66 as depicted in FIG. 4. Furthermore, use of the valve device 66 of FIG. 5 would permit any order or combination of the lateral wellbores 74*a, b* to be simultaneously and/or sequentially stimulated.

Figure 15:
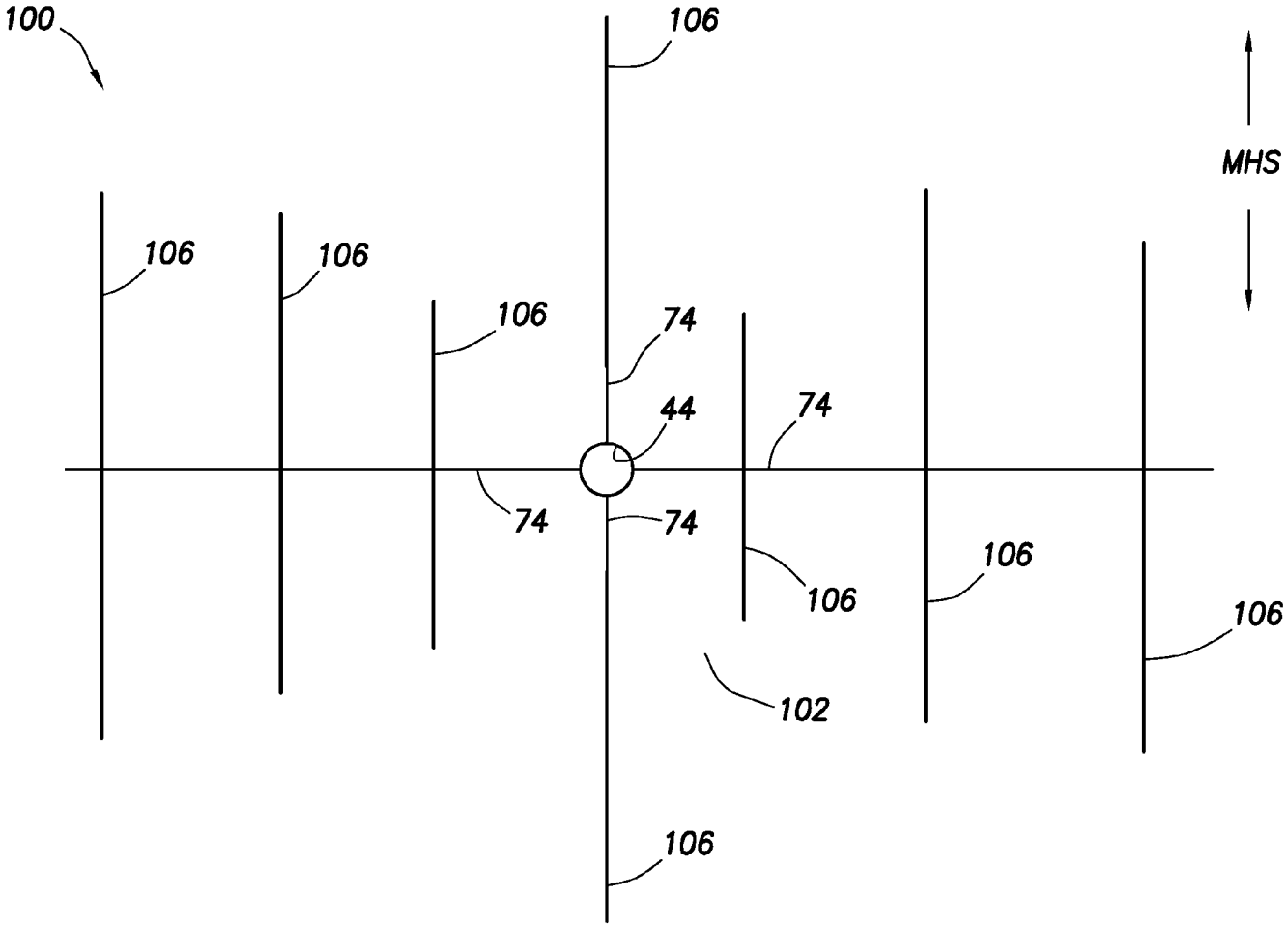
Figure 16:
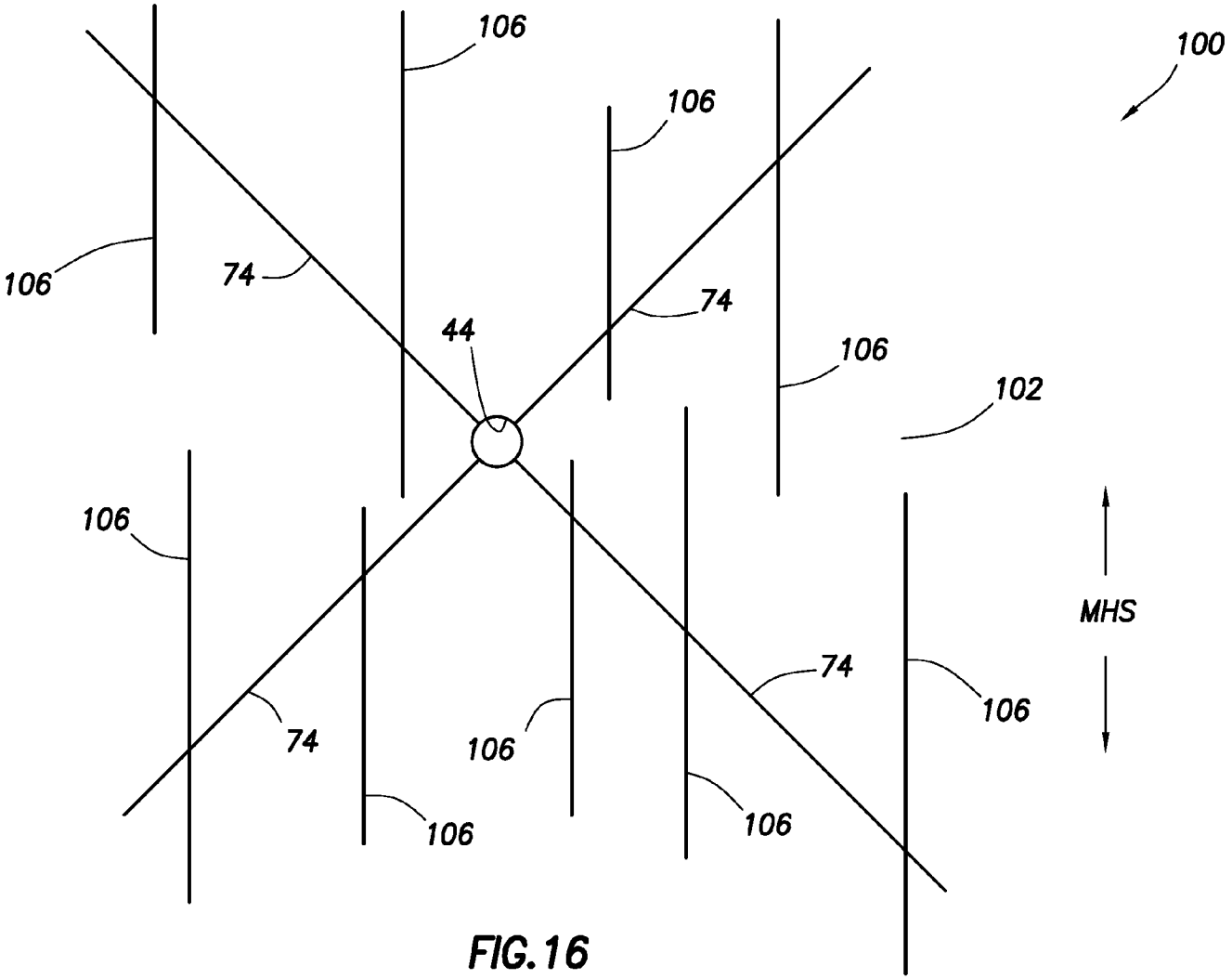

Referring additionally now to FIG. 15, a plan view of the system 100 is representatively illustrated in which some of the lateral wellbores 74 are oriented parallel to, and some of the lateral wellbores are oriented orthogonal to, a direction of maximum horizontal stress MHS in a zone 102. In FIG. 16, however, all of the lateral wellbores 74 are oriented approximately 45 degrees to the direction of maximum horizontal stress MHS in the zone 102. It is anticipated that the configuration of FIG. 16 will provide greatest reservoir connectivity (particularly in conjunction with the further enhancements described below), but it should be understood that any number, combination and orientation of lateral wellbores 74 may be used in keeping with the principles of this disclosure.

Figure 17:
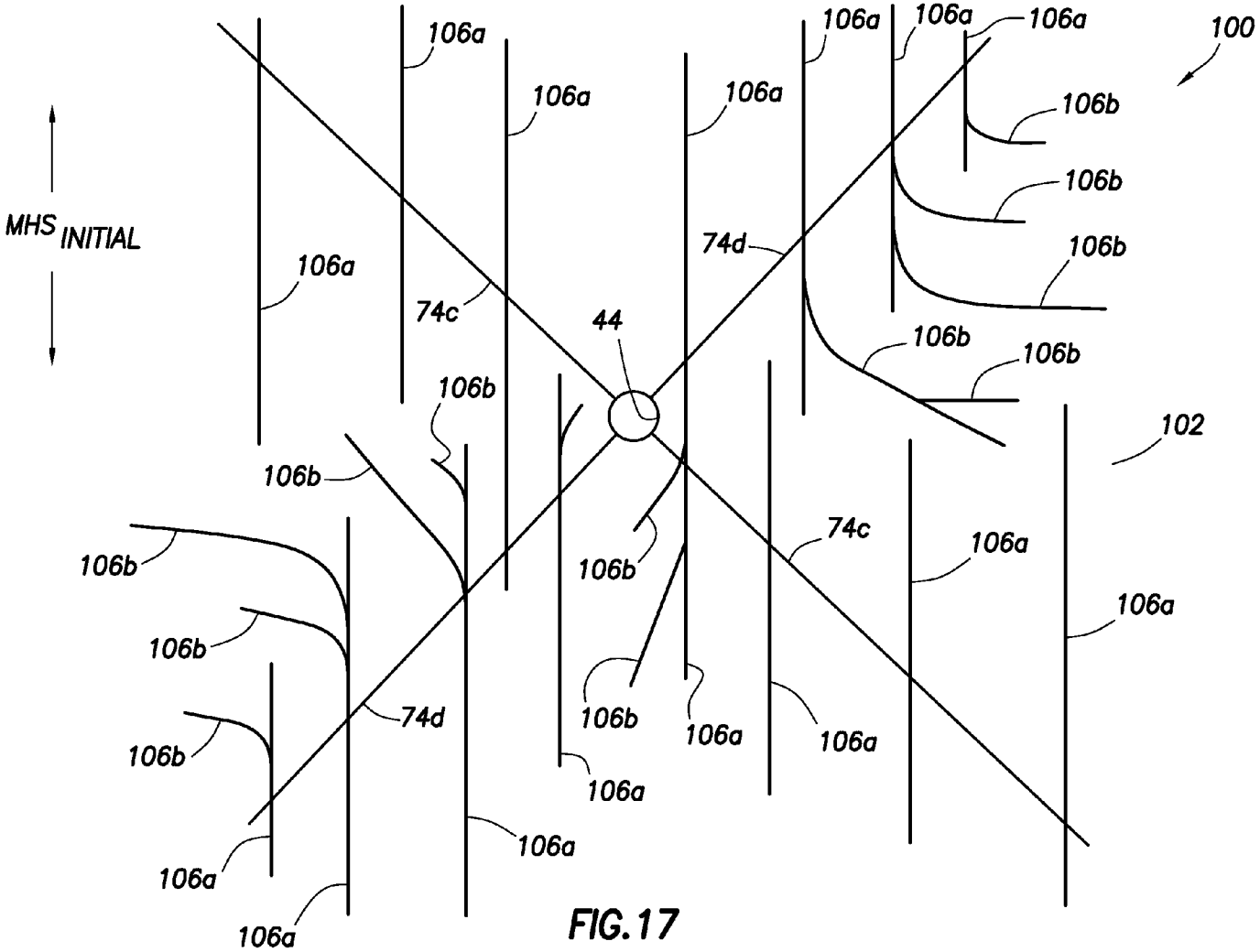

Referring additionally now to FIG. 17, the system 100 is representatively illustrated in another configuration in which the zone 102 surrounding four lateral wellbores 74*c, d* is simultaneously stimulated via all four of the wellbores, thereby forming initial fractures 106*a* in the zone generally in the direction of the maximum horizontal stress $MHS_{initial}$. However, this initial stimulation operation modifies the direction of maximum horizontal stress MHS, so that subsequent pressurizing of lateral wellbores 74*d* causes further fractures 106*b* to be formed in the zone 102, which subsequent fractures 106*b* deviate angularly from the initial direction of maximum horizontal stress MHS.

Indeed, the modified direction of maximum horizontal stress MHS could even be orthogonal to the initial direction of maximum horizontal stress, in which case the subsequent fractures 106*b* (or at least portions thereof) could extend orthogonal to the initial fractures 106*a*. This increased complexity in the fracturing of the zone 102 provides for greater connectivity between the pores of the formation and the lateral wellbores 74*c, d*, resulting in greater productivity.

Figure 18:
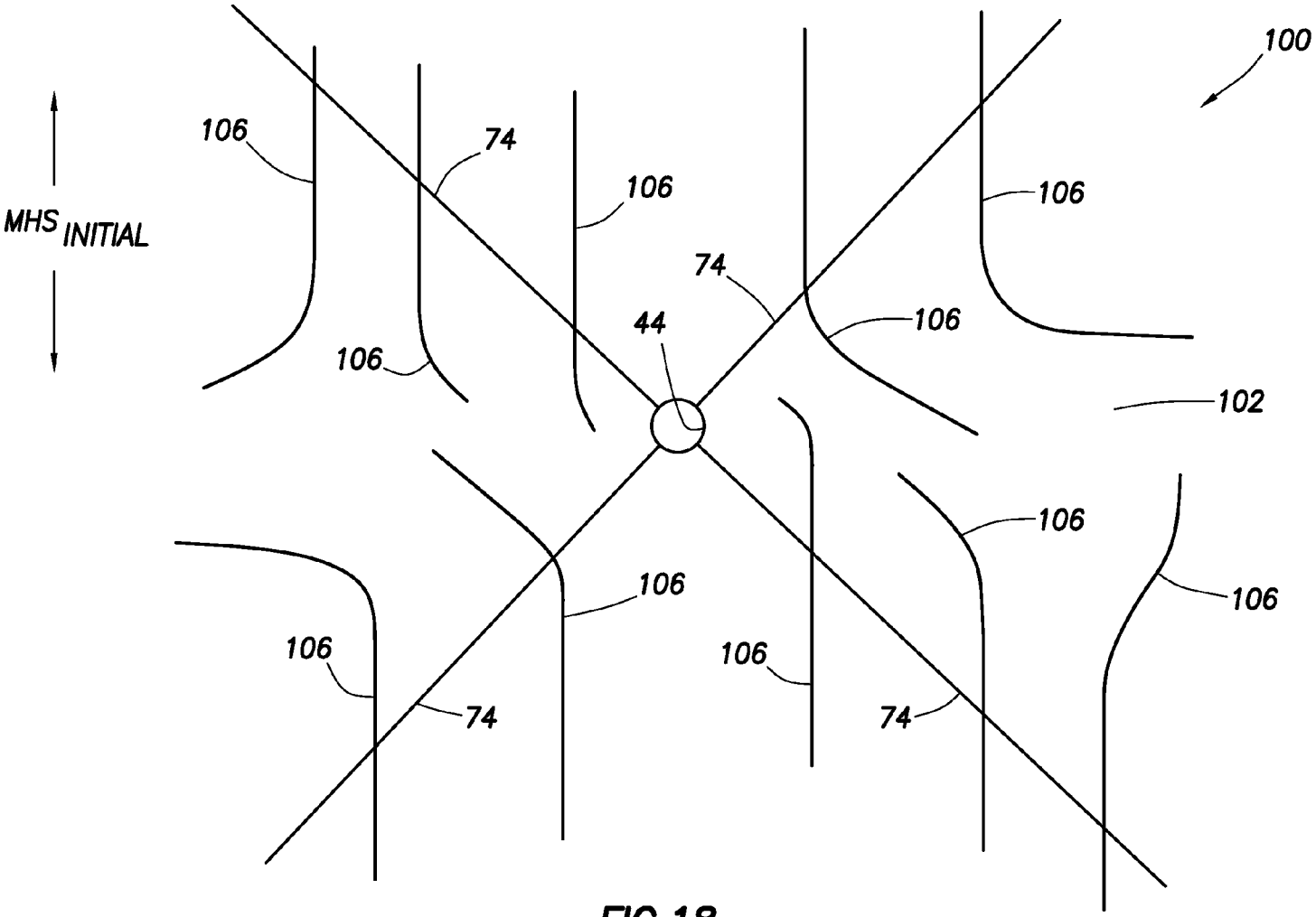

In FIG. 18, another configuration of the system 100 is representatively illustrated in which all of the lateral wellbores 74 are simultaneously stimulated. Initially, the fractures 106 extend in the direction of maximum horizontal stress $MHS_{initial}$. However, the direction of maximum horizontal stress MHS is changed as the stimulation operation proceeds. Thus, the fractures 106 change direction due to this stress direction modification, resulting in complex fracture shapes and greater reservoir connectivity.

Figure 19:
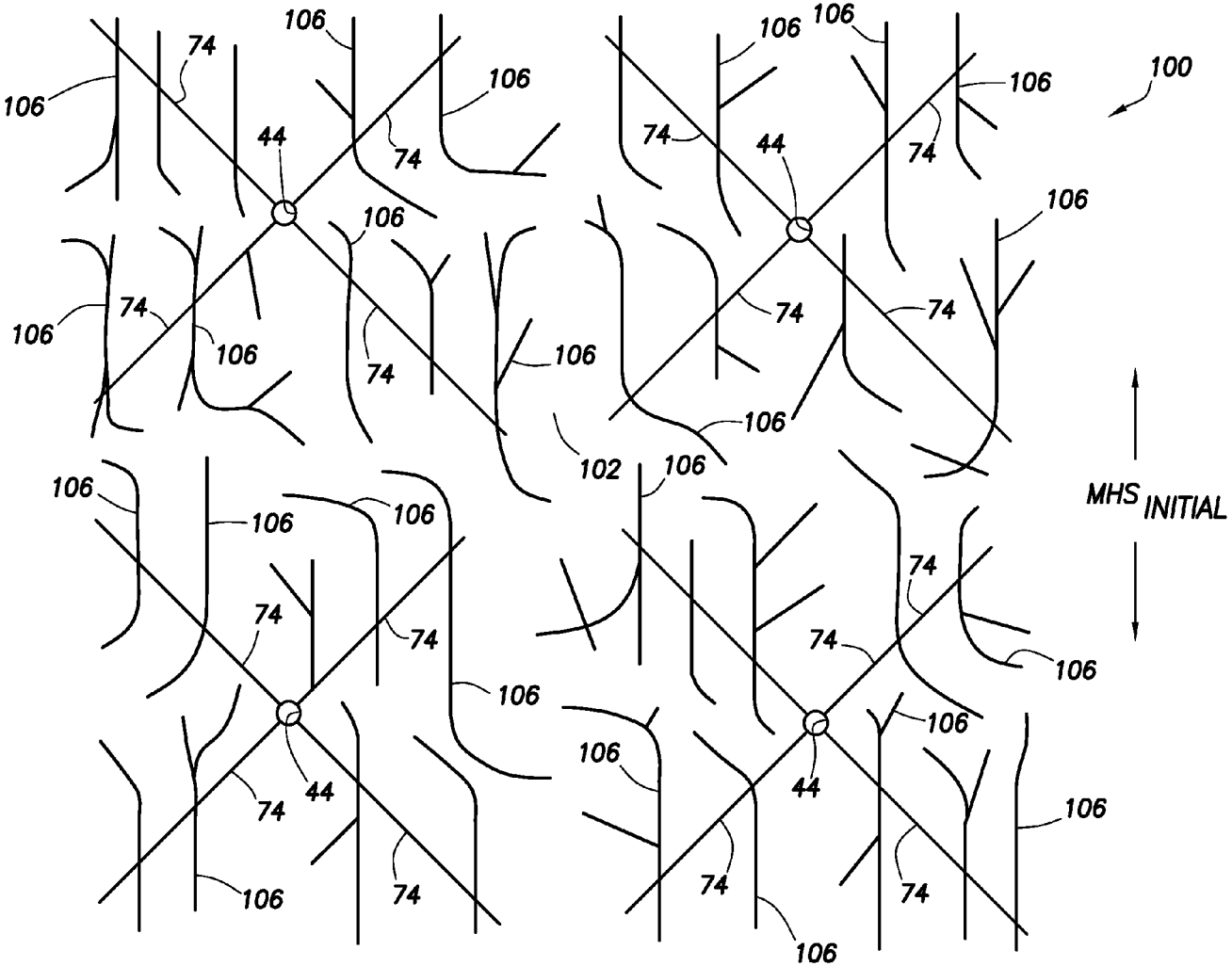

In FIG. 19, the principles described above are applied to a field, for example, over 160 acres with 40-acre well spacing. That is, lateral wellbores 74 are drilled outwardly from parent wellbores 44 drilled near the centers of respective 40-acre sections. The zone 102 surrounding the lateral wellbores 74 is stimulated simultaneously and/or sequentially from the parent wellbores 44 as described above, to produce very complex networks of fractures 106 in the zone 102.

Referring additionally now to FIG. 20, an enlarged view of one of the lateral wellbores 74 in the system 100 is representatively illustrated. In the configuration of FIG. 20, the lateral wellbore 74 can be drilled and the zone 102 surrounding the wellbores can be stimulated in a single trip of the drill string 84 into the well.

Specifically, the drill string 84 includes a valve device 112 (for example, a three-way valve, etc.) for selectively directing fluid flow from the drill string to either the drilling assembly 78 or to a stimulation tool 114. The stimulation tool 114 preferably includes at least one nozzle 116 for ejecting a stimulation fluid 118 outward into contact with the zone 102. The stimulation tool 114 and nozzle 116 are depicted in FIG. 20 as extending radially outward from the drill string 84 for illustration purposes, but preferably the stimulation tool and nozzle would not protrude from the exterior of the drill string in actual practice.

The stimulation fluid 118 may be similar to the cutting fluid 52 described above, in that it may include an abrasive component to provide for more efficient erosion of the zone 102 outward from the lateral wellbore 74. This erosion creates a fracture initiation 120 extending into the zone 102. An indexing device or swivel 122 may be used to extend the fracture initiation 120 circumferentially about the lateral wellbore 74.

In the associated method, the lateral wellbore 74 would be drilled to its desired depth, and then the valve device 112 would be operated to direct fluid flow to the stimulation tool 114. The stimulation fluid 118 would be ejected from the stimulation tool 114 to form the fracture initiation 120. Multiple fracture initiations 120 could be formed along the length of the lateral wellbore 74, in each location where it is desired to initiate a fracture 106.

The stimulation operation would include applying pressure to the interior of the lateral wellbore 74 to thereby form the fractures 106 extending outwardly from the fracture initiation (s) 120. As described above, such stimulation operations could be performed simultaneously in multiple lateral wellbores 74 and/or sequentially with one or a set of lateral wellbores being pressurized, followed by another one or set of lateral wellbores being pressurized. Of course, any number of lateral wellbores 74, any number of sets of lateral wellbores and any combination thereof may be simultaneously and/or sequentially stimulated in keeping with the principles of this disclosure.

Figure 21A:
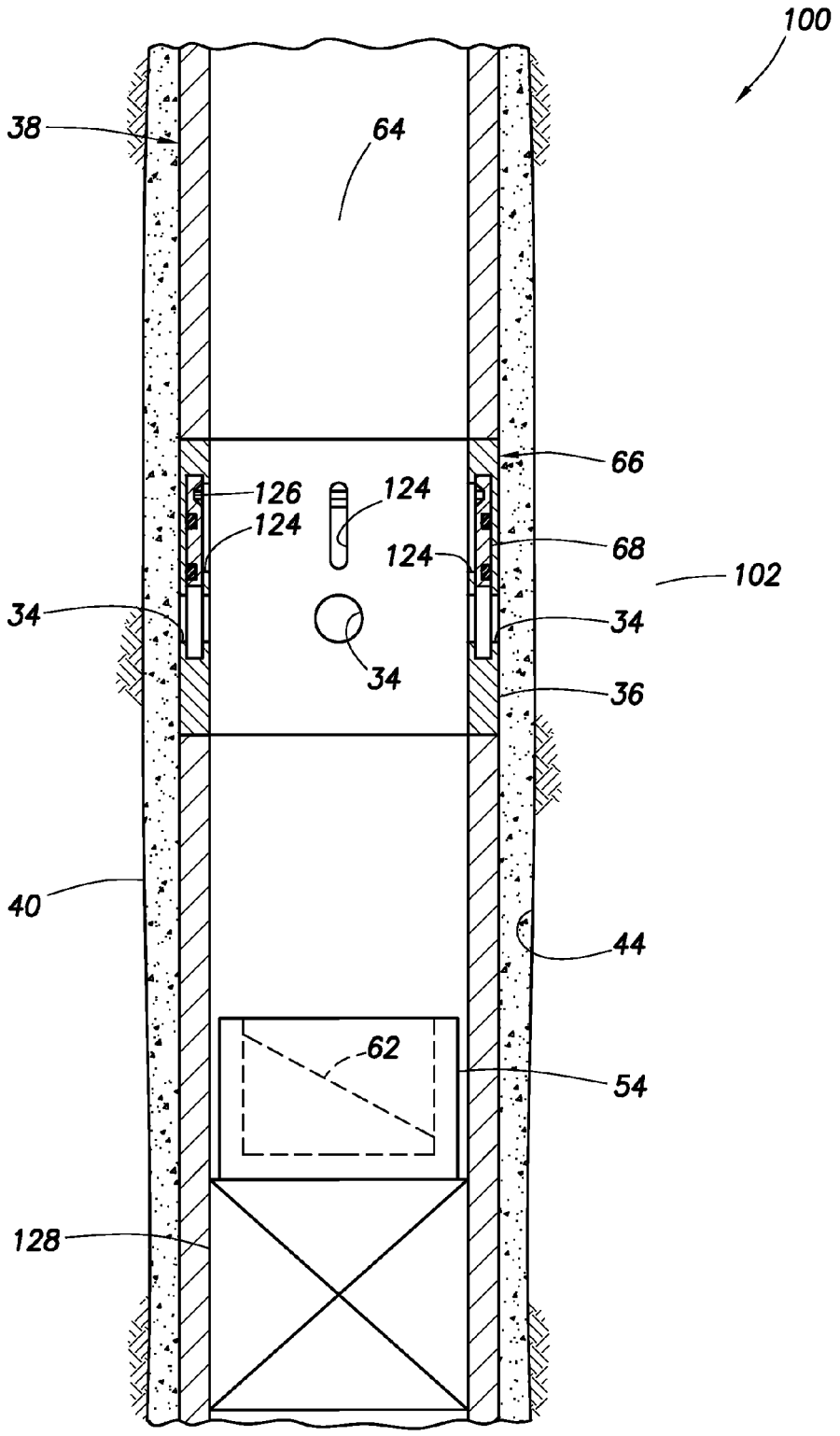
FIGS. 21A-C are schematic partially cross-sectional views of another system and method of drilling and stimulating multiple lateral wellbores embodying principles of the present specification.
Figure 21B:
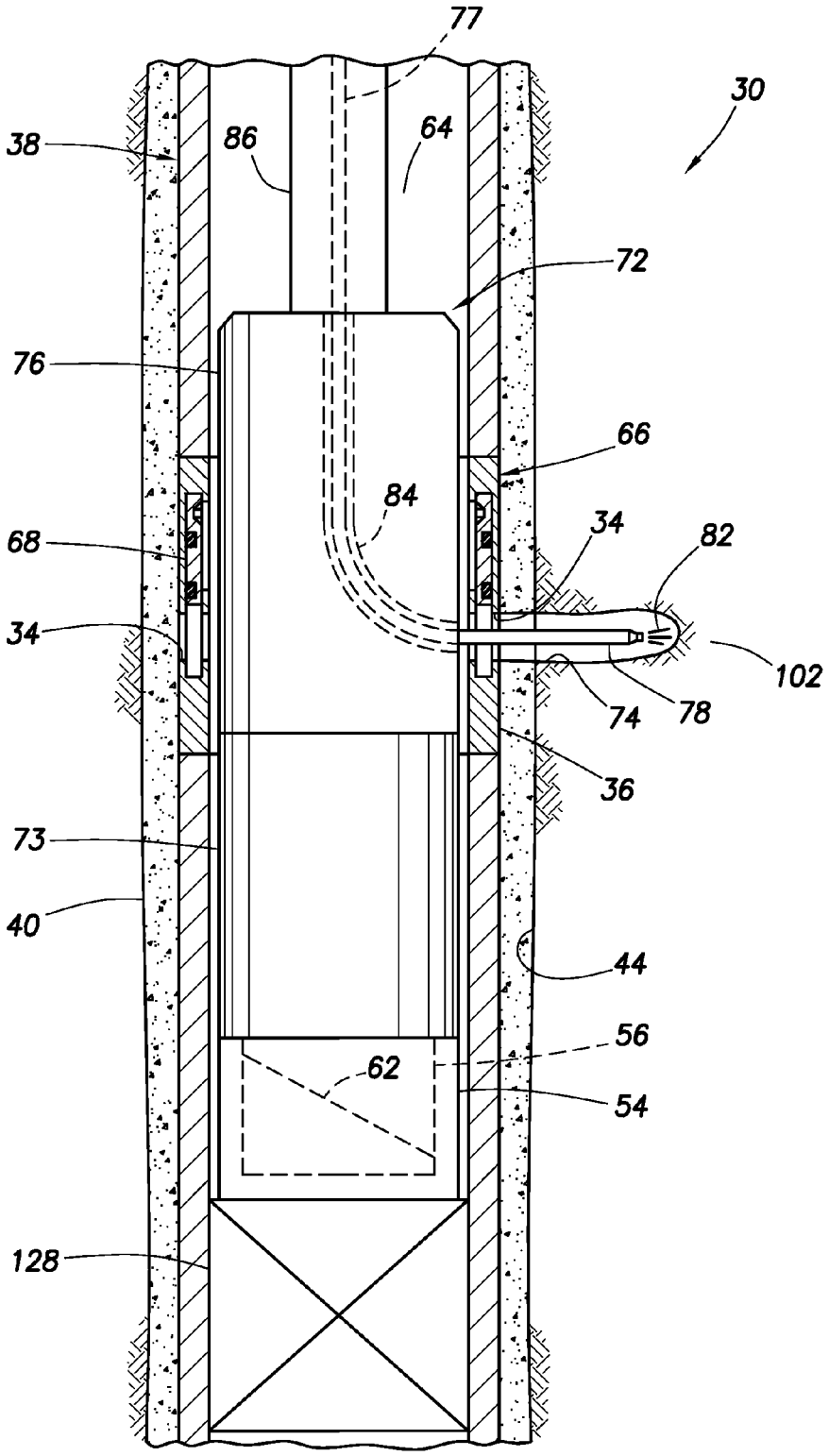
Figure 21C:
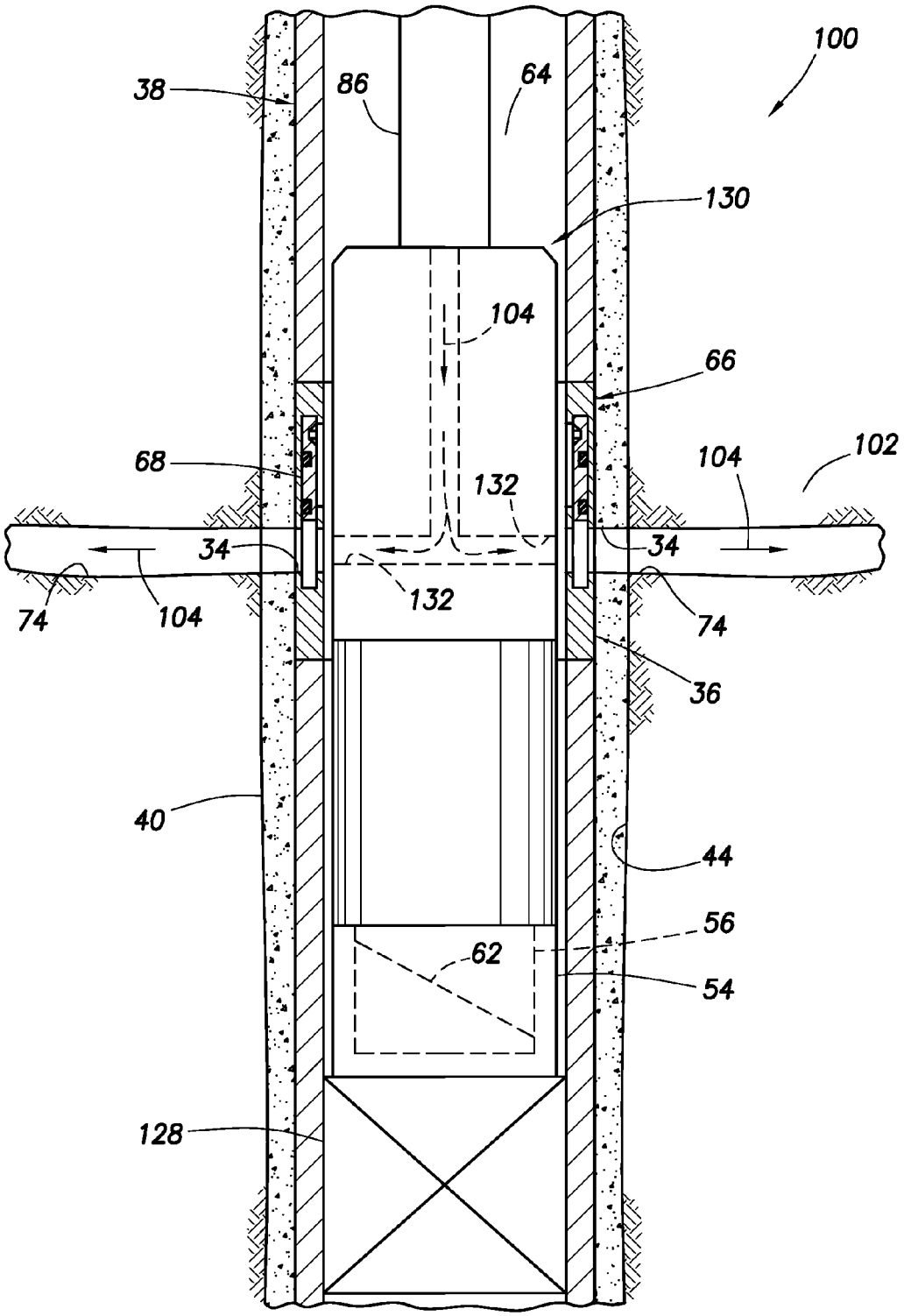

Referring additionally now to FIGS. 21A-C, the system 100 is representatively illustrated in another configuration in which the valve device 66 is used to permit simultaneous stimulation of the zone 102 surrounding multiple lateral wellbores 74. The valve device 66 in this configuration is particularly well designed for cementing in the parent wellbore 44 along with the casing section 36 and the remainder of the casing string 38.

In FIG. 21A it may be seen that the closure device 68 in this configuration is positioned within the sidewall of the valve device 66. Slots 124 in an interior of the sidewall permit access to a shifting profile 126 on the closure device 68.

As depicted in FIG. 21A, the closure device 68 has been shifted upward to open the openings 34 after the casing string 38 has been cemented in the parent wellbore 44. This displacement of the closure device 68 may be accomplished using a wireline-conveyed shifting tool (not shown) or other type of shifting tool (such as the shifting dogs 70 on the diverter assembly 72 as depicted in FIG. 4).

Note that the orienting device 54 is secured in the casing string 38 by means of an anchoring device 128 (such as a bridge plug or packer). Preferably, the orienting device 54 is azimuthally and longitudinally secured in a known position relative to the openings 34 prior to installation of the casing string 38 as described above, but the configuration of FIG. 21A demonstrates how the orienting device 54 can be installed later if desired.

In FIG. 21B, the lateral wellbore drilling system 30 described above is used for drilling lateral wellbores 74 extending outwardly from the parent wellbore 44 through the openings 34. The indexing device 73 is used to successively align the diverter device 76 azimuthally and longitudinally with each of the openings 34.

In FIG. 21C, the diverter assembly 72 has been retrieved and a stimulation assembly 130 has been conveyed into the parent wellbore 44. The stimulation assembly 130 includes an orienting tool 56 which cooperatively engages the orienting device 54 to thereby azimuthally and longitudinally align stimulation passages 132 of the assembly with the openings 34. Stimulation fluid 104 can now be flowed simultaneously into each of the lateral wellbores 74 from the stimulation assembly 130.

Figure 22:
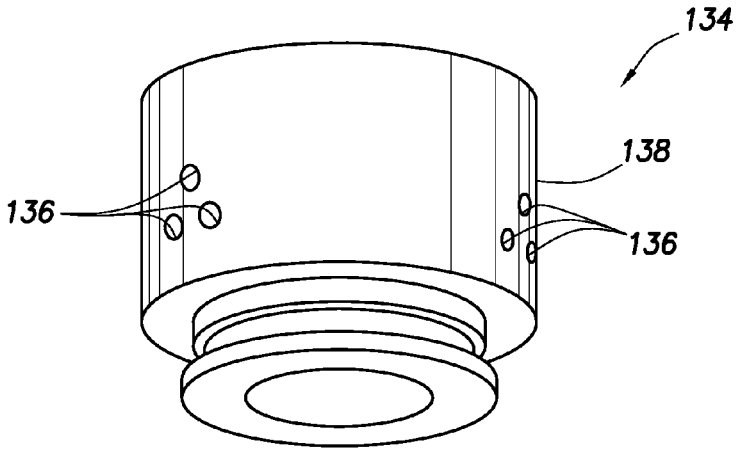
FIG. 22 is a schematic perspective side view of a jet cutting device which may be used in the systems and methods of the present specification.

Referring additionally now to FIG. 22, a jet cutting tool 134 which may be used in the jet cutting device 48 of FIGS. 2 & 3, or in the stimulation tool 114 of FIG. 20, is representatively illustrated. The jet cutting tool 134 includes uniquely configured nozzles 136 formed through a sidewall of a hollow generally cylindrical housing 138.

Specifically, the nozzles 136 are arranged in sets of three nozzles per set. Each of the nozzles 136 in a set is inclined both circumferentially and radially (relative to a central axis of the set of nozzles), so that a relatively large and generally circular erosion is created when fluid is ejected from the nozzles.

For example, in the system 30 described above, the jet cutting tool 134 can be used to form the openings 34 through the sidewall of the casing string 38. The circular shape of the openings 34 created by the nozzles 136 provides for ease of passing the drilling assembly 78 through the openings, and for sealing the plugging devices 108 at the openings.

It may now be fully appreciated that the present disclosure provides several beneficial advancements to the arts of drilling and stimulating lateral wellbores. The systems 30, 100 and associated methods described above permit lateral wellbores 74 to be efficiently and economically drilled or jetted, and also permit the formations or zones 102 surrounding the lateral wellbores to be effectively stimulated to enhance production.

In particular, the above disclosure provides the system 30 for drilling multiple lateral wellbores 74 extending outwardly from a parent wellbore 44. The system 30 includes a casing section 36 with multiple azimuthally spaced openings 34 formed through a sidewall of the casing section. An azimuthal orienting device 54 is connected to the casing section 36 with a predetermined azimuthal orientation between the orienting device and the openings 34.

A diverter assembly 72 of the system 30 includes an azimuthal and/or longitudinal indexing device 73 and a diverter device 76 for diverting a drilling assembly 78 from the parent wellbore 44 through the openings 34, whereby cooperative engagement between the diverter assembly and the orienting device aligns the diverter device with one of the openings. The indexing device 73 is operative to azimuthally and/or longitudinally align the diverter device 76 with successive ones of the openings 34.

The drilling assembly 78 may include a jet cutting tool which cuts through a formation 46 surrounding the parent wellbore 44 by erosion of the formation due to ejection of a fluid 82 from a nozzle 80 of the jet cutting tool. An acid-soluble cement 40 may be positioned between the openings 34 and the formation 46, and the fluid 82 may include an acidic component for at least partially dissolving the cement when the jet cutting tool is diverted through the openings and to facilitate the jet cutting of formation 46.

The diverter assembly 72 may include an orienting tool 56 for cooperative engagement with the orienting device 54. A longitudinal and azimuthal spacing between the diverter device 76 and the orienting tool 56 may be selected to correspond with a longitudinal and azimuthal spacing between the openings 34 and the orienting device 54 so that the diverter device is longitudinally and azimuthally aligned with one of the openings.

The orienting device 54 may include an orienting latch profile, and the orienting tool 56 may include an orienting latch. The orienting latch profile may be secured to an anchoring device 128 conveyed into and set within a casing string 38 in which the casing section 36 is interconnected. The orienting device 54 may include an orienting profile 62 secured to a casing string 38 in which the casing section 36 is interconnected, and the orienting tool 56 may include another orienting profile 62.

The diverter assembly 72 may also include a formation stimulation tool 114. A formation 46 surrounding the parent wellbore 44 may be drilled and stimulated during a single trip of the diverter assembly 72 into the parent wellbore.

The casing section 36 may include a displaceable closure device 68 for selectively permitting and preventing access and fluid flow through each of the openings 34.

The above disclosure also provides a method of drilling multiple lateral wellbores 74 extending outwardly from a parent wellbore 44. The method includes the steps of: drilling one of the lateral wellbores 74 by diverting a drilling assembly 78 from the parent wellbore 44 outward through one of multiple azimuthally spaced openings 34 formed through a sidewall of a valve device 66 interconnected in a casing string 38 in the parent wellbore; and drilling successive ones of the lateral wellbores 74 by performing the following steps for each of the successive lateral wellbores: a) azimuthally displacing the drilling assembly 78 into alignment with a respective one of the valve openings 34; and b) diverting the drilling assembly 78 through the respective one of the openings 34 to thereby drill the lateral wellbore 74.

The method may also include the step of, prior to the step of drilling one of the lateral wellbores 74, displacing a closure device 68 of the valve device 66 to thereby open the valve device.

The drilling assembly 78 may include a jet cutting tool, and the step of drilling one of the lateral wellbores 74 may include ejecting a fluid 82 from the jet cutting tool to thereby erode a formation 46 surrounding the parent wellbore 44. The fluid ejecting step may also include dissolving at least a portion of an acid-soluble cement 40 positioned between the casing string 38 and the formation 46.

The method may also include the step of stimulating each of the multiple lateral wellbores 74. The stimulating and drilling steps may be performed during a single trip of the drilling assembly 78 into the parent wellbore 44. The stimulating step may include fracturing a formation 46 surrounding each of the lateral wellbores 74.

The method may also include the step of azimuthally orienting a diverter assembly 72 with the openings 34 of the valve device 66 by engaging an orienting tool 56 of the diverter assembly with an azimuthal orienting device 54 connected to the casing string 38. The method can then include the step of, after the drilling steps, drilling through the orienting device 54 to thereby enlarge a flow passage 64 of the casing string 38.

The method may also include the step of, prior to the step of drilling one of the lateral wellbores 74, securing the orienting device 54 to the casing string 38 by setting an anchoring device 128 within the casing string. The orienting tool engaging step may include longitudinally orienting the diverter assembly 72 with the openings 34 of the valve device 66.

Another method of drilling multiple lateral wellbores 74 extending outwardly from a parent wellbore 44 is provided by the above disclosure. This method includes, for each of the lateral wellbores 74, performing the following steps during a single trip of a drilling assembly 78 into the parent wellbore 44: a) drilling the lateral wellbore 74 by displacing the drilling assembly 78 into a formation 46 surrounding the parent wellbore 44; and b) stimulating the formation 46 by flowing a stimulation fluid 118 through the drilling assembly 78 and outward into the formation.

The drilling and stimulating steps may be performed for all of the lateral wellbores 74 during a single trip of the drilling assembly 78 into the parent wellbore 44.

The stimulating step may include fracturing the formation 46.

The method may also include the step of, for each of the lateral wellbores 74, prior to the drilling step, azimuthally aligning a diverter device 76 of a diverter assembly 72 with a respective one of multiple openings 34 formed through a sidewall of a casing section 36 in the parent wellbore 44. The openings 34 may be included in a valve device 66 interconnected in the casing section 36.

The method may include the step of opening the valve device 66 prior to the drilling step by displacing a closure device 68 of the valve device.

The method may include the step of forming the openings 34 through the casing section 36 sidewall by positioning a jet cutting assembly 32 opposite the casing section sidewall and ejecting a cutting fluid 52 from the jet cutting assembly. The cutting fluid 52 may include an acidic component which at least partially dissolves an acid-soluble cement 40 external to the casing section 36 sidewall.

The method may also include the step of securing an azimuthal orienting device 56 relative to the casing section 36. The diverter device 76 azimuthally orienting step may include engaging the diverter assembly 72 with the orienting device 54, and the jet cutting assembly 32 positioning step may include engaging the jet cutting assembly with the orienting device.

The method may also the step of interconnecting a valve device 112 in the drilling assembly 78. The drilling step may include operating the valve device 112 to direct fluid to a nozzle 80, and the stimulating step may include operating the valve device to direct fluid to a stimulation tool 114.

Also provided by the above disclosure is a method of stimulating one or more subterranean zones 102 intersected by multiple lateral wellbores 74 extending outwardly from one or more patent wellbores 44. The method includes the steps of: simultaneously injecting a stimulation fluid 104 into the multiple lateral wellbores 74; and stimulating the one or more zones 102 intersected by the multiple lateral wellbores 74 in response to the stimulation fluid 104 injecting step.

The method may include the step of, during the stimulating step, selectively blocking injection of the stimulation fluid 104 into less than all of the lateral wellbores 74 by closing off one or more openings 34 in a sidewall of a casing string 38 in at least one parent wellbore 44. The selectively blocking step may include releasing plugging devices 108 into the casing string 38 during the injecting step, whereby the plugging devices close off the one or more openings 34 in the casing string sidewall corresponding to the selected lateral wellbores 74.

The injecting step may include simultaneously injecting the stimulation fluid 104 into multiple sets of the lateral wellbores 74*a, b* which extend into respective multiple ones of the zones 102*a, b*. One set of lateral wellbores 74 may extend outwardly from one parent wellbore 44, and another set of lateral wellbores may extend outwardly from another parent wellbore. Alternatively, or in addition, the multiple sets of lateral wellbores 74*a, b* may extend outwardly from a same parent wellbore 44.

In the injecting step, the stimulation fluid 104 may be injected into multiple lateral wellbores 74 extending outwardly from a single one of the parent wellbores 44. Alternatively, or in addition, in the injecting step, the stimulation fluid 104 may be injected into multiple lateral wellbores 74 extending outwardly from multiple parent wellbores 44.

The stimulating step may include fracturing the one or more zones 102 intersected by the multiple lateral wellbores 74 in response to the stimulation fluid 104 injecting step. The stimulating step may include altering a direction of maximum horizontal stress MHS in a formation 46 surrounding the one or more parent wellbores 44, and may also include the step of fracturing the formation after the maximum horizontal stress direction has been altered.

Also provided by the above disclosure is a method of drilling one or more lateral wellbores 74 extending outwardly from a parent wellbore 44. The method includes the steps of: engaging a cutting assembly 32, 28 with an orienting device 54 corresponding to a casing section 36 in the parent wellbore 44, such engagement achieving a predetermined azimuthal and longitudinal position of the cutting assembly relative to a first desired location for drilling a first one of the lateral wellbores through the casing section; cutting a first opening 34 through the casing section 36 at the first desired location using the cutting assembly 28, 32; and then engaging a drilling assembly 78 with the orienting device 54, thereby azimuthally and longitudinally aligning the drilling assembly with the first opening 34.

The cutting step may include jet cutting the first opening 34 through the casing section 36. The cutting step may include rotary cutting (e.g., milling or coring) the first opening 34 through the casing section 36. The cutting step may include utilizing a perforating gun 59 to cut the first opening 34 through the casing section 36.

The cutting assembly 28, 32 may include an indexing device 60. The method may include the step of operating the indexing device 60 to align a cutting tool 29, 48 of the cutting assembly 28, 32 with successive additional desired locations for drilling respective additional ones of the lateral wellbores 74.

The cutting step may include cutting additional openings 34 through the casing section 36 at the respective additional desired locations for drilling respective additional ones of the lateral wellbores 74.

The engaging step may include azimuthally and longitudinally aligning a drilling tool or nozzle 80 of the drilling assembly 78 with the first opening 34.

Of course, a person skilled in the art would, upon a careful consideration of the above description of representative embodiments, readily appreciate that many modifications, additions, substitutions, deletions, and other changes may be made to these specific embodiments, and such changes are within the scope of the principles of the present disclosure. Accordingly, the foregoing detailed description is to be clearly understood as being given by way of illustration and example only, the spirit and scope of the present invention being limited solely by the appended claims and their equivalents.

What is claimed is:

1. A system for drilling multiple lateral wellbores extending outwardly from a parent wellbore during a single trip into the parent wellbore, the system comprising:

a valve interconnected in a casing string positioned in the parent wellbore, the valve including a displaceable closure device which selectively permits and prevents access and fluid communication between an interior of the casing string and multiple openings formed through a sidewall of the valve, whereby in a first position the closure device permits access and fluid communication between the interior of the casing string and a first opening and prevents access and fluid communication between the interior of the casing string and a second opening, in a second position the closure device permits access and fluid communication between the interior of the casing string and the second opening and prevents access and fluid communication between the interior of the casing string and the first opening, in a third position the closure device permits access and fluid communication between the interior of the casing string and both of the first and second openings, and in a fourth position the closure device prevents access and fluid communication between the interior of the casing string and both of the first and second openings;

an orienting device connected to the casing string with a predetermined azimuthal and longitudinal orientation relative to the openings; and a diverter assembly which includes an indexing device and a diverter device which diverts a drilling assembly from the interior of the casing string through the openings, wherein cooperative engagement between the diverter assembly and the orienting device aligns the diverter device with the first opening during the single trip into the parent wellbore, and wherein the indexing device aligns the diverter device with the second opening during the single trip into the parent wellbore.

2. The system of claim 1, wherein the drilling assembly comprises a jet cutting tool which cuts through a formation surrounding the parent wellbore by erosion of the formation due to ejection of a fluid from a nozzle of the jet cutting tool.

3. The system of claim 2, wherein an acid-soluble cement is positioned between the openings and the formation, and wherein the fluid comprises an acidic component for at least partially dissolving the cement when the jet cutting tool is diverted through the openings.

4. The system of claim 1, wherein the diverter assembly further includes an orienting tool for cooperative engagement with the orienting device, a longitudinal and azimuthal spacing between the diverter device and the orienting tool being selected to correspond with a longitudinal and azimuthal spacing between the first opening and the orienting device so that the diverter device is longitudinally and azimuthally aligned with the first opening.

5. The system of claim 4, wherein the orienting device comprises an orienting latch profile, and wherein the orienting tool comprises an orienting latch.

6. The system of claim 5, wherein the orienting latch profile is secured to an anchoring device conveyed into and set within the casing string.

7. The system of claim 4, wherein the orienting device comprises a first orienting profile secured to the casing string, and wherein the orienting tool comprises a second orienting profile.

8. The system of claim 1, wherein the drilling assembly further includes a formation stimulation tool, whereby a formation surrounding the parent wellbore is drilled and stimulated during a single trip of the drilling assembly into the parent wellbore.

* * * * *